US010269517B2

(12) United States Patent
Ozaki et al.

(10) Patent No.: US 10,269,517 B2
(45) Date of Patent: Apr. 23, 2019

(54) CONTACT DEVICE, ELECTROMAGNETIC RELAY USING THE SAME, AND METHOD FOR MANUFACTURING CONTACT DEVICE

(71) Applicant: PANASONIC INTELLECTUAL PROPERTY MANAGEMENT CO., LTD., Osaka (JP)

(72) Inventors: Ryosuke Ozaki, Osaka (JP); Hideki Enomoto, Mie (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 15/309,411

(22) PCT Filed: Jun. 17, 2015

(86) PCT No.: PCT/JP2015/003014
§ 371 (c)(1),
(2) Date: Nov. 7, 2016

(87) PCT Pub. No.: WO2015/194169
PCT Pub. Date: Dec. 23, 2015

(65) Prior Publication Data

US 2017/0148596 A1 May 25, 2017

(30) Foreign Application Priority Data

Jun. 19, 2014 (JP) ..... 2014-126334
Apr. 9, 2015 (JP) ..... 2015-080428

(51) Int. Cl.
*H01H 67/02* (2006.01)
*H01H 50/14* (2006.01)
(Continued)

(52) U.S. Cl.
CPC ..... *H01H 50/14* (2013.01); *H01H 49/00* (2013.01); *H01H 50/023* (2013.01);
(Continued)

(58) Field of Classification Search
CPC ..... H01H 50/14
(Continued)

(56) References Cited

U.S. PATENT DOCUMENTS 927,739 A * 7/1909 Manson ..... H01H 50/54
335/187
1,391,944 A * 9/1921 Dodgson ..... H01H 50/14
174/153 R
(Continued)

FOREIGN PATENT DOCUMENTS

CN 102804318 A 11/2012
CN 103201814 A 7/2013
(Continued)

OTHER PUBLICATIONS

Inntemational Search Report and Written Opinion issued in International Patent Application No. PCT/JP2015/003014, dated Sep. 8, 2015; with English translation.
(Continued)

*Primary Examiner* — Alexander Talpalatski
(74) *Attorney, Agent, or Firm* — McDermott Will & Emery LLP

(57) ABSTRACT

A contact device of present invention includes a first contact portion, a first fixed terminal electrically connected to the first contact portion, a second contact portion, and a second fixed terminal electrically connected to the second contact portion. The contact device further includes a housing being box-like in shape and disposed so as to surround the first and second contact portions, the housing including a bottom plate having a first opening hole through which the first fixed terminal passes and a second opening hole through which the second fixed terminal passes. The contact device further includes a first insulating member being electrically insulating, annular, and directly or indirectly joined to the bottom plate around the first opening hole, and a second
(Continued)

insulating member being electrically insulating, annular, and directly or indirectly joined to the bottom plate around the second opening hole.

19 Claims, 19 Drawing Sheets

(51) Int. Cl.
*H01H 49/00* (2006.01)
*H01H 50/04* (2006.01)
*H01H 50/02* (2006.01)
*H01H 51/06* (2006.01)
*H01H 50/54* (2006.01)

(52) U.S. Cl.
CPC ..... *H01H 50/04* (2013.01); *H01H 51/065* (2013.01); *H01H 50/54* (2013.01)

(58) Field of Classification Search
USPC ..... 335/126, 131
See application file for complete search history.

(56) References Cited

U.S. PATENT DOCUMENTS 1,622,042 A * 3/1927 Miles ..... H01H 50/54 335/187
1,869,648 A * 8/1932 Ashworth ..... H01H 50/54 200/283
3,165,610 A * 1/1965 Goldberg ..... H01H 50/54 174/153 R
3,328,547 A * 6/1967 Van Loo ..... H01H 33/66 200/504
3,737,599 A * 6/1973 Zuvela ..... H01H 35/147 200/61.45 R
5,521,566 A * 5/1996 Krubsack ..... H01H 50/14 335/126
5,812,041 A * 9/1998 Ishikawa ..... H01H 11/0031 200/284
6,335,117 B1 1/2002 Yoshida et al.
6,404,310 B1 * 6/2002 Ando ..... F02N 15/00 335/131
8,310,323 B2 * 11/2012 Niimi ..... H01H 50/023 335/131
8,674,796 B2 * 3/2014 Ito ..... H01H 1/20 335/126
8,729,986 B2 * 5/2014 Choi ..... H01H 50/546 200/245
2013/0057369 A1 * 3/2013 Yano ..... H01H 1/66 335/156
2013/0214884 A1 8/2013 Ito et al.
2014/0106209 A1 4/2014 Deng et al.
2014/0106210 A1 4/2014 Deng et al.
2014/0357491 A1 * 12/2014 Nakagawa ..... H01F 6/06 505/163

FOREIGN PATENT DOCUMENTS

JP 50-025972 Y1 8/1975
JP 58-068642 U 5/1983
JP 61-178244 U 11/1986
JP S62-195921 U 12/1987
JP 63-314733 A 12/1988
JP H05-101731 A 4/1993
JP H08-022760 A 1/1996
JP 2000-058033 A 2/2000
JP 2002-217325 A 8/2002
JP 2009-193721 A 8/2009
JP 2014-523076 A 9/2014
WO 2011/115052 A1 9/2011
WO 2012/060087 A1 5/2012

OTHER PUBLICATIONS

English Translation of Chinese Search Report dated Feb. 5, 2018 for the related Chinese Patent Application No. 201880031046.2.

* cited by examiner

CONTACT DEVICE, ELECTROMAGNETIC RELAY USING THE SAME, AND METHOD FOR MANUFACTURING CONTACT DEVICE

CROSS-REFERENCE TO RELATED APPLICATIONS

This application is the U.S. National Stage of the International Application No. PCT/JP2015/003014, filed on Jun. 17, 2015, which claims the benefit of foreign priority of Japanese Patent Application 2014-126334, filed on Jun. 19, 2014 and Japanese Patent Application No. 2015-080428, filed on Apr. 9, 2015, the contents all of which are incorporated herein by reference.

TECHNICAL FIELD

The present invention generally relates to a contact device and an electromagnetic relay using the same, and more specifically, to a contact device having a box-like housing surrounding two contact portions, and an electromagnetic relay using the same.

BACKGROUND ART

Conventionally, there has been provided a contact device in which, for example, an airtight (sealed) space is formed with a box-like housing (a box-like sealed vessel), and contact portions are housed in the airtight space. With the contact device of such a kind, in order to secure insulation, airtightness, and heat resistance, the airtight space is defined by a housing made of ceramic, for example. However, since a ceramic-made housing tends to contract when sintered, it is difficult to improve dimensional precision.

On the other hand, there has been proposed a contact device (a contact switching device) in which the airtight space is formed by integrally joining a ceramic plate, which holds fixed terminals (fixed contact terminals), and the upper opened edge of a metal tubular flange to each other (see Patent Literature 1, for example). Patent Literature 1 discloses that higher dimensional precision can be secured by a combination of a plate-like ceramic (a ceramic plate) and a metal tubular flange as compared to the case where a box-like ceramic is employed.

Further, in a contact device (a magnet switch for a starter) disclosed in Patent Literature 2, fixed terminals (fixed contacts) are fixed to an insulating contact case in the state where the fixed terminals penetrate through the side surface of the insulating contact case and clamp the insulating contact case. Here, at the side surface of the insulating contact case, conical through holes are formed for the fixed terminals to be inserted and disposed. In the through holes, heat-resistant insulating spacers made of a ceramic-base material are disposed. By the fixed terminals being inserted into the heat-resistant insulating spacers, they are indirectly held to the insulating contact case. Further, according to Patent Literature 2, the insulating heat-resistant spacers are conical in shape, and just tightening the fixed terminals causes the fixed terminals to be disposed concentrically.

CITATION LIST

Patent Literature

PTL 1: International Publication No. WO 2011/115052

PTL 2: Unexamined Japanese Patent Publication No. H08-22760

SUMMARY OF THE INVENTION

However, with the contact device disclosed in Patent Literature 1, since the fixed terminals are directly held to the ceramic plate, the positions of the fixed terminals may vary if dimensional precision of the ceramic plate is low.

Further, with the contact device disclosed in Patent Literature 2, while the fixed terminals are indirectly held to the insulating contact case via the heat-resistant insulating spacers, the heat-resistant insulating spacers are formed to be conical and disposed in the conical through holes of the insulating contact case. Accordingly, with the structure disclosed in Patent Literature 2 also, the positions of the fixed terminals may vary if dimensional precision of the heat-resistant insulating spacers made of a ceramic-base material is low. Further, according to Patent Literature 2, since the insulating contact case that indirectly holds the fixed terminals via the heat-resistant insulating spacers is made of resin, the positions of the fixed terminals may similarly vary as compared to the case where the fixed terminals are held to a metal-made case whose dimensional precision is high.

The present invention has been made in view of the foregoing, and an object thereof is to provide a contact device capable of reducing variations in the positions of the fixed terminals, an electromagnetic relay using the same, and a method for manufacturing the contact device.

A contact device according to one aspect of the present invention includes: a first contact portion; a first fixed terminal that is electrically connected to the first contact portion; a second contact portion; a second fixed terminal that is electrically connected to the second contact portion; a housing that is box-like and disposed so as to surround the first contact portion and the second contact portion, the housing including a bottom plate having a first opening hole through which the first fixed terminal passes and a second opening hole through which the second fixed terminal passes; a first insulating member that is electrically insulating, annular, and directly or indirectly joined to the bottom plate around first opening hole; and a second insulating member that is electrically insulating, annular, and directly or indirectly joined to the bottom plate around the second opening hole. The first fixed terminal penetrates through a first region surrounded by the first insulating member. The second fixed terminal penetrates through a second region surrounded by the second insulating member. The first insulating member has a first housing-side joining portion to which the housing is directly or indirectly joined. The second insulating member has a second housing-side joining portion to which the housing is directly or indirectly joined. The first insulating member has a first terminal-side joining portion to which the first fixed terminal is directly or indirectly joined. The second insulating member has a second terminal-side joining portion to which the second fixed terminal is directly or indirectly joined. At least one of following (1) and (2) is satisfied: (1) the first housing-side joining portion is provided at a lower surface of the first insulating member; and (2) the first terminal-side joining portion is provided at an upper surface of the first insulating member. At least one of following (3) and (4) is satisfied: (3) the second housing-side joining portion is provided at a lower surface of the second insulating member; and (4) the second terminal-side joining portion is provided at an upper surface of the second insulating member.

An electromagnetic relay according to one aspect of the present invention includes: the contact device of the present invention; and an electromagnet device that drives to open and close the contact portions.

A method for manufacturing a contact device according to one aspect of the present invention is a method for manufacturing a contact device including: a first contact portion; a first fixed terminal that is electrically connected to the first contact portion; a second contact portion; a second fixed terminal that is electrically connected to the second contact portion; a housing that is box-like and disposed so as to surround the first contact portion and the second contact portion, the housing including a bottom plate having a first opening hole through which the first fixed terminal passes and a second opening hole through which the second fixed terminal passes; a first insulating member that is electrically insulating, annular, and directly or indirectly joined to the bottom plate around the first opening hole; and a second insulating member that is electrically insulating, annular, and directly or indirectly joined to the bottom plate around the second opening hole. The method includes: a fixing step of causing the first fixed terminal to penetrate through a first region surrounded by the first insulating member and causing the second fixed terminal to penetrate through a second region surrounded by the second insulating member; and a joining step of joining the first insulating member to the bottom plate around the first opening hole and joining the second insulating member to the bottom plate around the second opening hole while adjusting relative positions of the first and second fixed terminals relative to the housing, so that the first fixed terminal is held to the housing via the first insulating member and the second fixed terminal is held to the housing via the second insulating member.

The present invention is advantageous in that, since the fixed terminals are held to the housing via the annular insulating members, use of the housing of relatively high dimensional precision can reduce variations in the positions of the fixed terminals as compared to the case where an insulating housing is used.

Further, in connection with the contact device of the present invention, each of the two fixed terminals is held to the housing via the annular insulating member. The insulating member is provided with, at least at its upper surface or its lower surface, the joining portion relative to the fixed terminal or the housing. Hence, the dimensional precision of the distance between the two fixed terminals can be advantageously improved.

DESCRIPTION OF EMBODIMENTS

First Exemplary Embodiment (1) Overview

Figure 1:
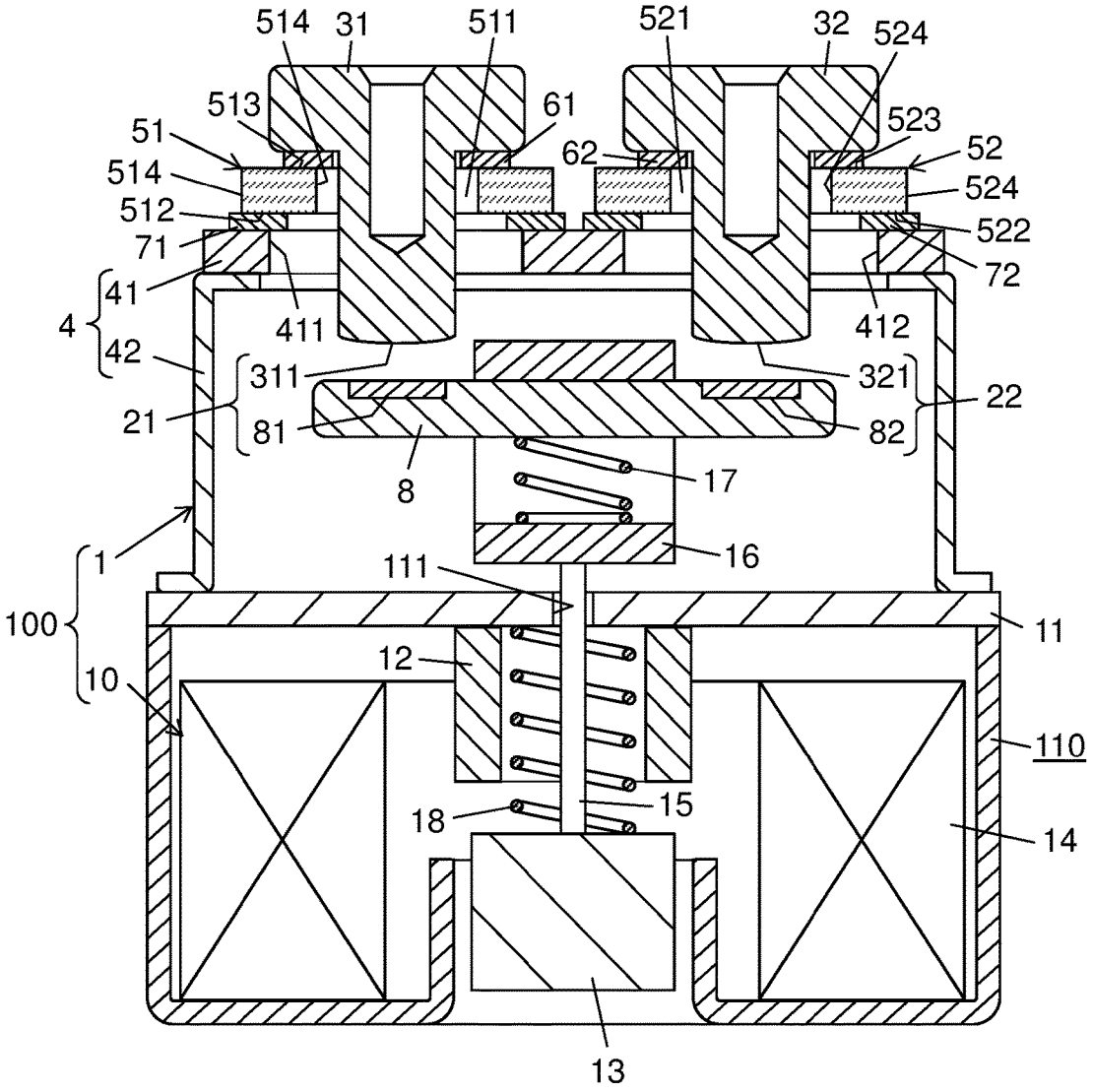
FIG. 1 is a cross-sectional view showing an electromagnetic relay according to a first exemplary embodiment.

As shown in FIG. 1, contact device 1 according to the present exemplary embodiment includes contact portions 21, 22, fixed terminals 31, 32, housing 4, and insulating members 51, 52.

Fixed terminals 31, 32 are electrically connected to contact portions 21, 22, respectively. Housing 4 is box-like in shape, and disposed so as to surround contact portions 21, 22. Opening holes 411, 412 for causing fixed terminals 31, 32 to pass through are formed at bottom plate 41 of housing 4.

Insulating members 51, 52 are electrically insulating and annular, surrounding hollow portions 511, 521, respectively. Insulating members 51, 52 are joined to bottom plate 41, around opening holes 411, 412, respectively, via housing-side spacers 71, 72. Note that, as will be described later, housing-side spacers 71, 72 are not necessarily structured, and insulating members 51, 52 may be directly joined around opening holes 411, 412, respectively.

Fixed terminals 31, 32 penetrate through hollow portions 511, 521 (a first region, a second region), respectively, which are regions surrounded by insulating members 51, 52, respectively. Then, fixed terminals 31, 32 are fixed to insulating members 51, 52, respectively, and held to housing 4 via insulating members 51, 52.

Further, insulating members 51, 52 have housing-side joining portions 512, 522 to which housing 4 is joined, and terminal-side joining portions 513, 523 to which fixed terminals 31, 32 are joined, respectively.

Here, in the surface of insulating members 51, 52, at positions where housing-side joining portions 512, 522 and terminal-side joining portions 513, 523 are spaced apart from each other, electrically insulating insulation securing portions 514, 524 are respectively provided.

Note that, insulation securing portions 514, 524 are not additionally structured to the insulating members as separate members. For the sake of convenience for description, the ring-like external surfaces of insulating members 51, 52 are referred to as insulation securing portions 514, 524, respectively.

With this structure, fixed terminals 31, 32 are held to housing 4 via annular insulating members 51, 52. Insulating members 51, 52 respectively have, at least at their respective upper surfaces or lower surfaces, joining portions relative to fixed terminals 31, 32 or housing 4. Hence, dimensional precision of the distance between two fixed terminals 31, 32 can be improved.

Housing 4 having high dimensional precision may be implemented by, for example, metal-made housing 4. In this case also, electrical insulation between fixed terminals 31, 32 and housing 4 can be secured by insulating members 51, 52.

Additionally, insulating members 51, 52 are joined to bottom plate 41 of housing 4 around opening holes 411, 412. Accordingly, with the present contact device 1, provided that dimensional precision of insulating members 51, 52 is low, adjusting the joining positions of insulating members 51, 52 relative to bottom plate 41 can reduce variations in the positions of fixed terminals 31, 32.

Further, in the surface of insulating members 51, 52, at positions where housing-side joining portions 512, 522 and terminal-side joining portions 513, 523 are spaced apart from each other, electrically insulating insulation securing portions 514, 524 are provided. Thus, the creepage distance along the surface of insulating members 51, 52 between housing 4 and fixed terminals 31, 32 is secured by insulation securing portions 514, 524. In sum, provision of insulation securing portions 514, 524 at the surface of insulating members 51, 52 advantageously improves the insulating performance between housing 4 and fixed terminals 31, 32, and the improved insulating performance contributes toward improving the pressure resistance of contact device 1.

Further, the present exemplary embodiment shows an example where a pair of (two) opening holes 411, 412 are formed at housing 4. Fixed terminals 31, 32 and insulating members 51, 52 are respectively provided as many as opening holes 411, 412 so as to be in a one-to-one relationship with opening holes 411, 412. Note that, the number of the opening holes, the fixed terminals, and the insulating members are not limited to two, and may be one or three or more.

In the following, a detailed description will be given of contact device 1 according to the present exemplary embodiment. Contact device 1 described in the following is merely an example of the present invention. The present invention is not limited to the following embodiment, and with other embodiments also, various changes can be made according to design or the like within a range not departing from the technical idea of the present invention.

In the present exemplary embodiment, a description is given of an example where, as shown in FIG. 1, contact device 1 and electromagnet device 10 structure electromagnetic relay 100. That is, electromagnetic relay 100 includes contact device 1, and electromagnet device 10 that drives to open and close contact portions 21, 22. Note that, contact device 1 is not limited to be used for electromagnetic relay 100, and may be used for, for example, a breaker (a circuit-breaker) or a switch. In the present exemplary embodiment, a description is given of the case where electromagnetic relay 100 is mounted on an electric vehicle (EV), and contact portions 21, 22 are electrically connected to a DC power supply path from a traveling-use battery to a load (for example, an inverter).

(2) Structure of Contact Device (2.1) Contact Portions

As shown in FIG. 1, contact device 1 according to the present exemplary embodiment includes, as contact portions 21, 22, a pair of fixed contacts 311, 321 and a pair of movable contacts 81, 82 disposed so as to oppose to the pair of fixed contacts 311, 321.

In the following, for the sake of convenience for description, the direction in which fixed contacts 311, 321 and movable contacts 81, 82 oppose to each other is defined as the top-bottom direction, and the orientation toward fixed contacts 311, 321 as seen from movable contacts 81, 82 is defined as the upper side. Further, the direction in which the pair of fixed contacts 311, 321 aligns is defined as the right-left direction, and the orientation toward fixed contact 321 as seen from fixed contact 311 is defined as the right side. That is, the following description is based on the orientations top, bottom, right and left as in FIG. 1. Further, in the following description, the direction perpendicular to both the top-bottom direction and the right-left direction (the direction perpendicular to FIG. 1) is the front-rear direction. However, such directions are not intended to limit the usage mode of contact device 1.

One (first) fixed contact 311 is provided at the lower end of one (first) fixed terminal 31, and other (second) fixed contact 321 is provided at the lower end of other (second) fixed terminal 32. Thus, a pair of fixed terminals 31, 32 is electrically connected to a pair of fixed contacts 311, 321 at contact portions 21, 22. A pair of movable contacts 81, 82 is provided at a plate-like movable contactor 8 which is made of an electrically conductive metal material. Thus, the pair of movable contacts 81, 82 is electrically connected to each other via movable contactor 8.

(2.2) Fixed Terminals

A pair of fixed terminals 31, 32 is disposed so as to align in the right-left direction. The pair of fixed terminals 31, 32 are each made of an electrically conductive metal material, and functions as terminals for connecting external circuits (a battery and a load) to contact portions 21, 22 (a pair of fixed contacts 311, 321). In the present exemplary embodiment, as an example, fixed terminals 31, 32 made of copper (Cu) are employed. However, it is not intended to limit fixed terminals 31, 32 to be made of copper, and fixed terminals 31, 32 may be made of an electrically conductive material other than copper.

Each of fixed terminals 31, 32 is formed to be a circular column having a circular cross section taken along a plane perpendicular to the top-bottom direction. Here, fixed terminals 31, 32 have increased-diameter portions 313, 323, respectively (see FIG. 2) at their upper ends whose outer diameter is greater than that of small-diameter portions 312, 322 (see FIG. 2) at their bottom ends, and therefore fixed terminals 31, 32 are each T-shaped in a front view.

While a detail will be given in the following section "(2.4) Housing", a pair of fixed terminals 31, 32 is held to housing 4 in the state where fixed terminals 31, 32 penetrate through opening holes 411, 412, respectively, formed at bottom plate 41 of housing 4.

(2.3) Movable Contactor

Movable contactor 8 is formed to be a quadrangular plate elongated in the right-left direction, and disposed below a pair of fixed terminals 31, 32 so that the opposite ends in the longitudinal direction (the right-left direction) thereof respectively oppose to lower ends of the pair of fixed terminals 31, 32. In movable contactor 8, at sites opposing to the lower ends (fixed contacts 311, 321) of the pair of fixed terminals 31, 32, a pair of movable contacts 81, 82 is provided.

Movable contactor 8 is held by holder 16, whose description will be given later, inside housing 4, and driven together with holder 16 in the top-bottom direction by electromagnet device 10 disposed below housing 4. The structure of holder 16 will be detailed in the following section "(3) Structure of Electromagnet Device". Thus, movable contacts 81, 82 provided at movable contactor 8 shift between the closed position where they are in contact with corresponding fixed contacts 311, 321 and the open position where they are spaced apart from fixed contacts 311, 321.

When both movable contacts 81, 82 are in the closed position, that is, in the state where contact portions 21, 22 are closed (hereinafter referred to as the "closed state"), a pair of fixed terminals 31, 32 are short-circuited via movable contactor 8. Accordingly, in contact device 1, fixed terminal 31 is electrically connected to one of a battery and a load, and fixed terminal 32 is electrically connected to the other one, whereby a DC power supply path from the battery to the load is formed in the closed state.

Note that, movable contacts 81, 82 may be integrally structured with movable contactor 8, for example by part of movable contactor 8 being hammered out, or may be formed separately from movable contactor 8 and fixed to movable contactor 8. Similarly, fixed contacts 311, 321 may be integrally structured with fixed terminals 31, 32, or may be formed separately from fixed terminals 31, 32 and fixed to fixed terminals 31, 32.

(2.4) Housing

In the present exemplary embodiment, housing 4 is formed to be hollow rectangular parallelepiped-like which is elongated in the right-left direction (see FIG. 2) and opens on the bottom side. Housing 4 is disposed so as to surround contact portions 21, 22. Bottom plate 41 of housing 4 is quadrangular plate-like and positioned above contact portions 21, 22, and forms the upper surface of housing 4. Housing 4 has, in addition to bottom plate 41, tubular portion 42 that extends downward from the outer circumferential portion of the lower surface of bottom plate 41. In other words, tubular portion 42 is a quadrangular tube whose upper end and lower end are opened. This upper end is closed by bottom plate 41. However, housing 4 is just required to be formed to be box-like surrounding contact portions 21, 22, and is not limited to be hollow rectangular parallelepiped-like as in the present exemplary embodiment. For example, housing 4 may be bottomed elliptical tubular or hollow polygonal prism-like. That is, the term box-like as used herein refers to a general shape having a space for housing contact portions 21, 22, and is not intended to limit the shape of tubular portion 42 to rectangular parallelepiped-like. For example, when housing 4 is bottomed elliptical tubular, tubular portion 42 is elliptical tubular with its upper end and lower end being opened, and the upper end is closed by elliptical bottom plate 41.

Note that, the lower surface of tubular portion 42 is closed by yoke upper plate 11 of electromagnet device 10, whose description will be given later. Specifically, tubular portion 42 has its lower end joined to yoke upper plate 11 by welding, for example. Thus, contact portions 21, 22 are housed in the space surrounded by bottom plate 41 and tubular portion 42 of housing 4 and yoke upper plate 11. The structure of electromagnet device 10 will be detailed in the following section "(3) Structure of Electromagnet Device".

In the present exemplary embodiment, housing 4 is made of metal, and bottom plate 41 and the site other than bottom plate 41 (tubular portion 42) are separate members. In sum, while both bottom plate 41 and tubular portion 42 are made of metal, bottom plate 41 and tubular portion 42 are separate members. Bottom plate 41 being joined to tubular portion 42 structures housing 4 with tubular portion 42. Further, in example of FIG. 1, while the thickness dimension of bottom plate 41 is set to be greater than the thickness dimension of the site other than bottom plate 41 (tubular portion 42), the thickness dimensions may be identical to each other.

In the present exemplary embodiment, as an example, bottom plate 41 made of Alloy 42 (Fe-42Ni) is employed. However, it is not intended to limit bottom plate 41 to be made of Alloy 42, and bottom plate 41 may be made of Kovar or stainless steel (SUS304 or the like), for example. Further, in the present exemplary embodiment, as an example, tubular portion 42 made of stainless steel (SUS304 or the like) is employed. However, it is not intended to limit tubular portion 42 to be made of stainless steel, and tubular portion 42 may be made of Alloy 42 (Fe-42Ni), Kovar or the like.

At bottom plate 41 of housing 4, a pair of opening holes 411, 412 for causing a pair of fixed terminals 31, 32 to pass through is formed. The pair of opening holes 411, 412 are each circularly formed, and penetrate bottom plate 41 in the thickness direction (the top-bottom direction). One (first) fixed terminal 31 is disposed at one (first) opening hole 411, and other (second) fixed terminal 32 is disposed at other (second) opening hole 412.

(2.5) Structure for Fixing Fixed Terminals

Next, a detailed description will be given of a structure for fixing fixed terminals 31, 32 to housing 4.

In the present exemplary embodiment, since fixed terminals 31, 32 are identically structured, the following description will be given focusing on one (first) fixed terminal 31 unless otherwise specified. Note that other (second) fixed terminal 32 is similarly structured. That is, in the following description, fixed terminal 31, (first) opening hole 411, (first) small-diameter portion 312, and (first) increased-diameter portion 313 can be read as fixed terminal 32, (second) opening hole 412, (second) small-diameter portion 322, and (second) increased-diameter portion 323, respectively. Further, (first) insulating member 51, (first) terminal-side spacer 61, and (first) housing-side spacer 71 can be read as (second) insulating member 52, (second) terminal-side spacer 62, and (second) housing-side spacer 72, respectively. Further, (first) housing-side joining portion 512, (first) terminal-side joining portion 513, and (first) insulation securing portions 514 can be read as (second) housing-side joining portion 522, (second) terminal-side joining portion 523, and (second) insulation securing portions 524, respectively. In the second and following exemplary embodiments also, unless otherwise specified, a description will be given focusing on one (first) fixed terminal 31. Note that other (second) fixed terminal 32 is similarly structured.

Figure 2:
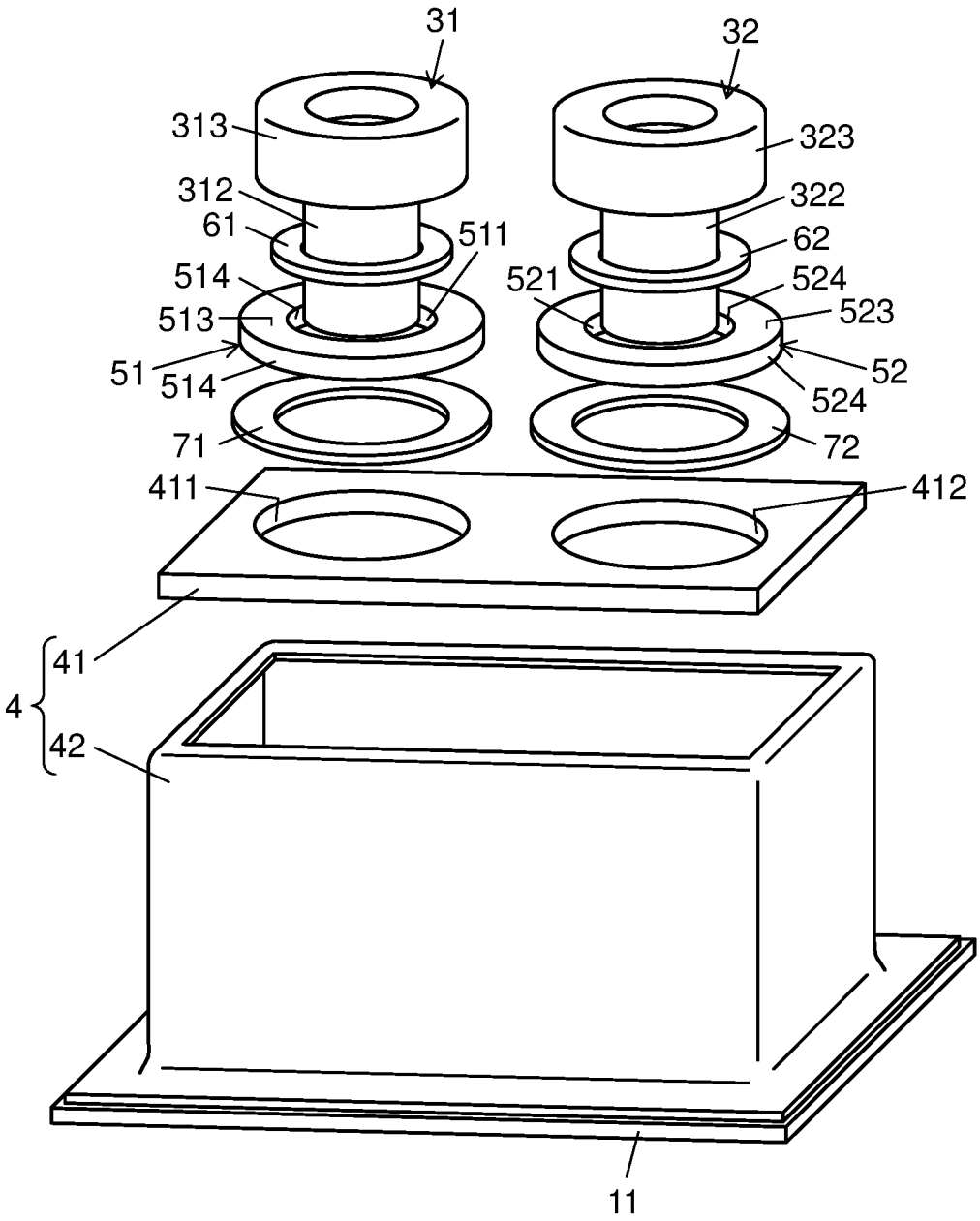
FIG. 2 is an exploded perspective view showing the main part of a contact device according to the first exemplary embodiment.

Insulating member 51 is made of an insulating material, and functions to secure electrical insulation at least between fixed terminal 31 and housing 4. Here, as shown in FIG. 2, insulating member 51 is annularly formed, with its both upper surface and lower surface being flat. Insulating member 51 has hollow portion 511 which is circularly opened on the inner side of insulating member 51. In the present exemplary embodiment, as an example, insulating member 51 made of ceramic such as aluminum oxide (alumina) is employed. However, it is not intended to limit insulating member 51 to be made of ceramic, and insulating member 51 may be made of insulating material such as glass, for example.

Insulating member 51 is joined to bottom plate 41 around opening hole 411. Then, fixed terminal 31 is fixed to insulating member 51 as being penetrating through hollow portion 511 of insulating member 51 in the penetrating direction. Thus, fixed terminal 31 is held indirectly to housing 4 via at least insulating member 51. In the present exemplary embodiment, the "penetrating direction" in which fixed terminal 31 penetrates through hollow portion 511 is the top-bottom direction.

In the present exemplary embodiment, housing-side joining portion 512 joined to housing 4 is provided at the lower surface of insulating member 51, and terminal-side joining portion 513 joined to fixed terminal 31 is provided at the upper surface of insulating member 51. The outer side surface and the inner side surface of insulating member 51 respectively structure insulation securing portions 514. Details of insulating member 51 will be described in the following section "(2.6) Details of Insulating Member".

Further, in the present exemplary embodiment, metal-made terminal-side spacer 61 is provided between fixed terminal 31 and insulating member 51. Fixed terminal 31 is joined to terminal-side joining portion 513 of insulating member 51 via terminal-side spacer 61, thereby fixed to insulating member 51. Here, as shown in FIG. 2, terminal-side spacer 61 is annularly shaped with its both upper surface and lower surface being flat. In the present exemplary embodiment, as an example, terminal-side spacer 61 made of Alloy 42 (Fe-42Ni) is employed. However, it is not intended to limit terminal-side spacer 61 to be made of Alloy 42, and terminal-side spacer 61 may be made of Kovar or the like, for example.

Further, in the present exemplary embodiment, metal-made housing-side spacer 71 is provided between insulating member 51 and bottom plate 41 of housing 4. Housing-side joining portion 512 of insulating member 51 is joined to bottom plate 41 via housing-side spacer 71, thereby fixed to bottom plate 41. Here, as shown in FIG. 2, housing-side spacer 71 is annularly shaped with its both upper surface and lower surface being flat. In the present exemplary embodiment, as an example, housing-side spacer 71 made of Alloy 42 (Fe-42Ni) is employed. However, it is not intended to limit housing-side spacer 71 to be made of Alloy 42, and housing-side spacer 71 may be made of Kovar or the like, for example.

Note that, in the example shown in FIG. 1, both the thickness dimension of terminal-side spacer 61 and the thickness dimension of housing-side spacer 71 are set to be smaller than the thickness dimension of insulating member 51.

In sum, in contact device 1 according to the present exemplary embodiment, fixed terminal 31 is indirectly held to bottom plate 41 of housing 4 via terminal-side spacer 61, insulating member 51, and housing-side spacer 71. In the following, with reference to FIGS. 1 and 3, a detailed description will be given of the relationship among fixed terminal 31, terminal-side spacer 61, insulating member 51, housing-side spacer 71, and bottom plate 41.

Housing-side spacer 71, insulating member 51, and terminal-side spacer 61 are disposed so as to be stacked on the upper surface of bottom plate 41 in order of housing-side spacer 71, insulating member 51, and terminal-side spacer 61. Here, housing-side spacer 71, insulating member 51, and terminal-side spacer 61 are disposed so that their respective center axes in a plane perpendicular to the top-bottom direction (a horizontal plane) match with opening hole 411.

Fixed terminal 31 is disposed so that small-diameter portion 312 penetrates through terminal-side spacer 61, insulating member 51, and housing-side spacer 71 on the inner side thereof, and so that increased-diameter portion 313 is overlaid on terminal-side spacer 61. In this state, the lower end of small-diameter portion 312 of fixed terminal 31 projects downward from bottom plate 41 (into housing 4) through opening hole 411.

Further, fixed terminal 31 is indirectly joined to insulating member 51 via terminal-side spacer 61, by the lower surface of increased-diameter portion 313 being joined to the upper surface of terminal-side spacer 61 and the lower surface of terminal-side spacer 61 being joined to the upper surface of insulating member 51. That is, fixed terminal 31 is indirectly joined to terminal-side joining portion 513 provided at the upper surface of insulating member 51 via terminal-side spacer 61. Further, insulating member 51 is indirectly joined to housing (bottom plate 41) 4 via housing-side spacer 71, by the lower surface of insulating member 51 being joined to the upper surface of housing-side spacer 71 and the lower surface of housing-side spacer 71 being joined around opening hole 411 at the upper surface of bottom plate 41. That is, housing-side joining portion 512 provided at the lower surface of insulating member 51 is indirectly joined to housing 4 via housing-side spacer 71.

Here, in joining members to each other, a proper method is selected in accordance with the materials of two members to be joined to each other. In the present exemplary embodiment, as an example, copper-made fixed terminal 31 and Alloy 42-made terminal-side spacer 61 are joined to each other by brazing. Further, joining of terminal-side spacer 61 and ceramic-made insulating member 51, and joining of insulating member 51 and Alloy 42-made housing-side spacer 71 are also carried out by brazing. Housing-side spacer 71 and Alloy 42-made bottom plate 41 are joined to each other by welding. Note that, bottom plate 41 and stainless steel-made tubular portion 42 are joined to each other by welding.

Figure 3:
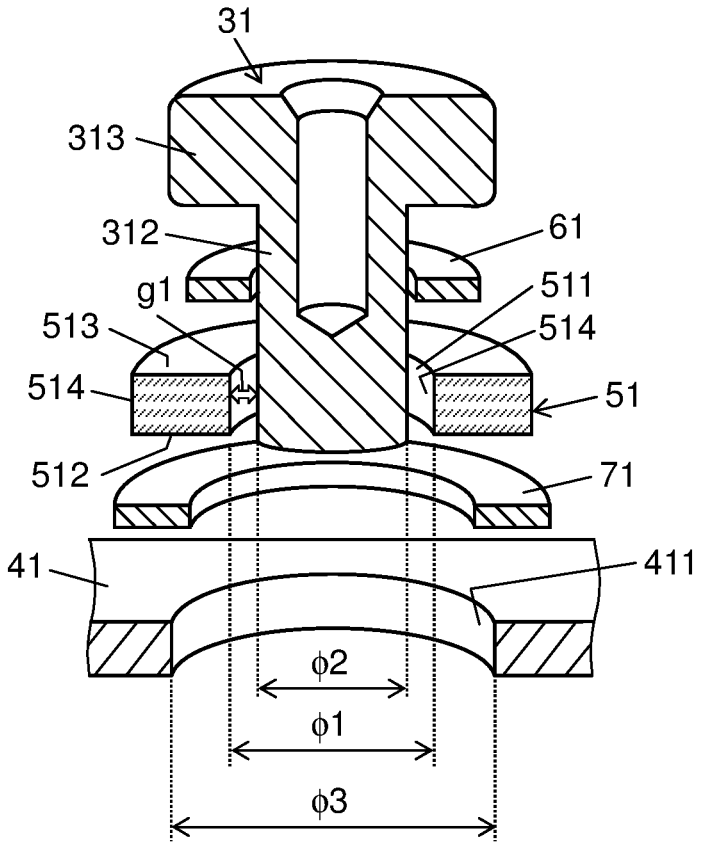
FIG. 3 is a perspective cross-sectional view showing the main part of the contact device according to the first exemplary embodiment.

Further, in the present exemplary embodiment, as shown in FIG. 3, inner diameter φ1 of insulating member 51 is set to be greater than outer diameter φ2 of small-diameter portion 312 of fixed terminal 31 that penetrates through hollow portion 511. Between the inner side surface of insulating member 51 and the outer side surface of fixed terminal 31, clearance g1 (see FIG. 3) is formed. Further, inner diameter φ3 of opening hole 411 is set to be greater than inner diameter φ1 of insulating member 51 (φ3>φ1>φ2).

Further, in contact device 1 according to the present exemplary embodiment, fixed terminal 31 is airtightly joined to insulating member 51 so that the inner space of housing 4 becomes airtight space, and insulating member 51 is airtightly joined to bottom plate 41. More specifically, fixed terminal 31 and terminal-side spacer 61 are airtightly joined to each other, and bottom plate 41 and housing-side spacer 71 are airtightly joined to each other. Further, terminal-side spacer 61 and housing-side spacer 71 are both airtightly joined to insulating member 51. Between bottom plate 41 and tubular portion 42, and between tubular portion 42 and yoke upper plate 11 are also airtightly joined.

Further, preferably, arc-extinguishing gas containing hydrogen, for example, is enclosed in the inner space of housing 4. Thus, provided that arc occurs when contact portions 21, 22 housed in housing 4 open, the arc can be rapidly cooled by the arc-extinguishing gas and extinguished. Note that, it is not essential that arc-extinguishing gas is enclosed in housing 4.

Meanwhile, a method for manufacturing the above-described contact device 1 preferably includes at least a fixing step of fixing fixed terminal 31 penetrating through hollow portion 511 to insulating member 51, and a joining step of joining insulating member 51 to bottom plate 41 around opening hole 411. In the joining step, insulating member 51 is joined to bottom plate 41 around opening hole 411 so that fixed terminal 31 is held to housing 4 via insulating member 51, while the relative position of fixed terminal 31 relative to housing 4 is being adjusted.

That is, by brazing or the like, fixed terminal 31 is fixed to insulating member 51 (the fixing step), and thereafter insulating member 51 is joined to housing 4 while the position of fixed terminal 31 relative to housing 4 is being adjusted (the joining step). More specifically, in the fixing step, fixed terminal 31 and terminal-side spacer 61 are joined to each other; terminal-side spacer 61 and terminal-side joining portion 513 of insulating member 51 are joined to each other; and housing-side joining portion 512 of insulating member 51 and housing-side spacer 71 are joined to each other. Thus, fixed terminal 31 is integrated with terminal-side spacer 61, insulating member 51, and housing-side spacer 71. In the following joining step, by housing-side spacer 71 and housing (bottom plate 41) 4 being joined to each other, insulating member 51 is joined to housing 4 via housing-side spacer 71.

The method for manufacturing contact device 1 described above preferably includes: a fixing step of causing (first) fixed terminal 31 to penetrate through hollow portion 511 (first region) surrounded by (first) insulating member 51 and causing (second) fixed terminal 32 to penetrate through hollow portion 512 (second region) surrounded by (second) insulating member 52; and a joining step of joining (first) insulating member 51 to bottom plate 41 around (first) opening hole 411 and joining (second) insulating member 52 to bottom plate 41 around (second) opening hole 412 while adjusting relative positions of (first and second) fixed terminals 31, 32 relative to housing 4, so that (first) fixed terminal 31 is held to housing 4 via (first) insulating member 51 and (second) fixed terminal 32 is held to housing 4 via (second) insulating member 52.

According to the present manufacturing method, the step of fixing fixed terminal 31 to insulating member 51 (the fixing step) and the step of joining insulating member 51 to housing 4 (the joining step) are separate steps. Accordingly, in joining insulating member 51, to which fixed terminal 31 is previously fixed, to housing 4, by adjusting the relative position between housing 4 and fixed terminal 31 (and fixed terminal 32), fixed terminal 31 (and fixed terminal 32) can be precisely positioned irrespective of the dimensional precision of insulating member 51 (and insulating member 52).

Note that, the shape of each member described above is merely an example, and can be changed as appropriate. For example, insulating member 51, terminal-side spacer 61, and housing-side spacer 71 are not each limited to be circular annular, and may be polygonal (pentagonal, hexagonal or the like). As to fixed terminal 31 and opening hole 411 also, they may each have a polygonal cross-sectional shape taken perpendicularly to the top-bottom direction.

(2.6) Details of Insulating Member

Figure 4A:
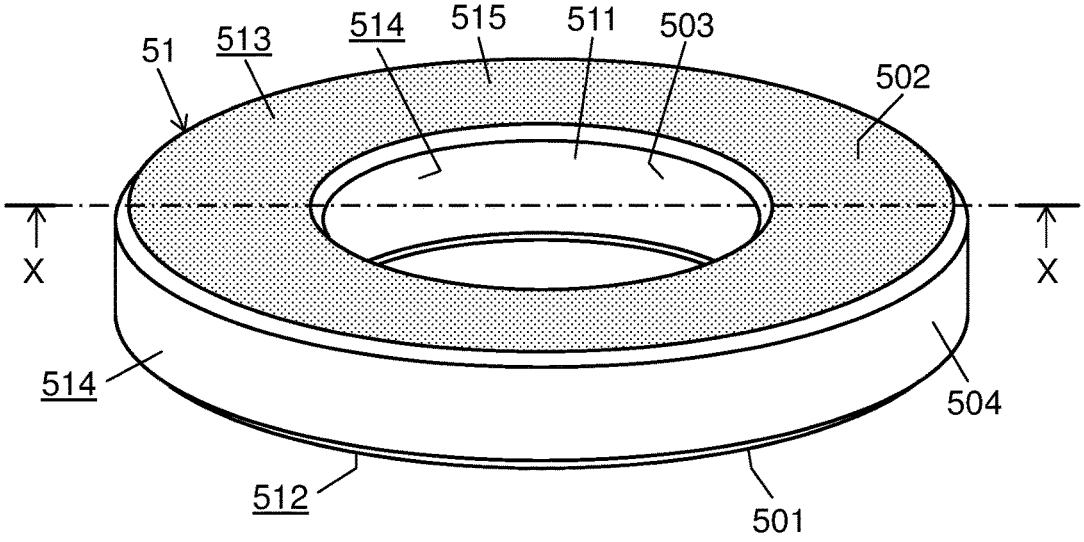
FIG. 4A is a perspective view showing an insulating member according to the first exemplary embodiment.
Figure 4B:
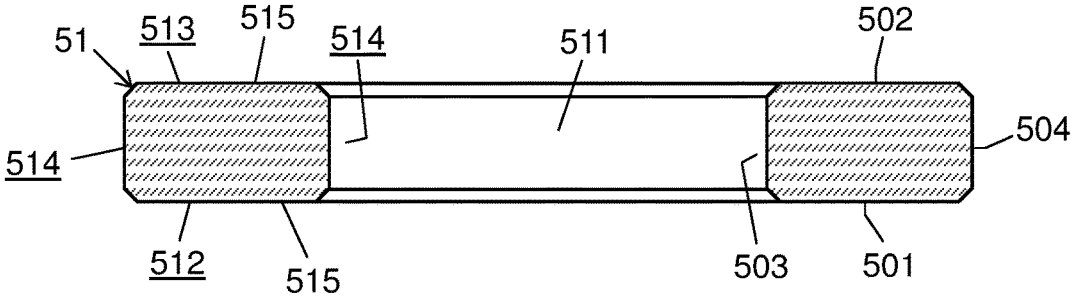
FIG. 4B is a cross-sectional view taken along line X-X in FIG. 4A.

Next, with reference to FIGS. 4A and 4B, details of insulating member 51 will be described.

Insulating member 51 is structured to be annular with a predetermined thickness. Insulating member 51 has its corners formed between the opposite end surfaces in the thickness direction (lower surface 501 and upper surface 502) and inner side surface (the surface surrounding hollow portion 511) 503 chamfered. Similarly, insulating member 51 has its corners formed between the opposite end surfaces in the thickness direction (lower surface 501 and upper surface 502) and outer side surface 504 chamfered. Note that, the chamfering is not essential for insulating member 51, and can be omitted as appropriate. In the drawings in which insulating member 51 is schematically shown, such as FIG. 1, a detailed shape such as chamfering is not shown as appropriate.

Housing-side joining portion 512 is provided at one end surface in the top-bottom direction (the penetrating direction) of insulating member 51 (herein, lower surface 501). Terminal-side joining portion 513 is provided at other end surface in the top-bottom direction (the penetrating direction) of insulating member 51 (herein, upper surface 502). In other words, insulating member 51 has a first joining surface (lower surface 501) and a second joining surface (upper surface 502) respectively on opposite sides in the thickness direction, and housing-side joining portion 512 is provided at the first joining surface and terminal-side joining portion 513 is provided at the second joining surface. In the present exemplary embodiment, as an example, substantially the entire first joining surface except for the chamfered portions structures housing-side joining portion 512, and substantially the entire second joining surface except for the chamfered portions structures terminal-side joining portion 513. Note that, in the drawings showing insulating member 51 (FIGS. 4A, 4B and the like), the shaded (dotted) region represents housing-side joining portion 512 or terminal-side joining portion 513.

Insulation securing portions 514 are provided at the position, in the surface of insulating member 51, where housing-side joining portion 512 and terminal-side joining portion 513 are spaced apart from each other. That is, in the surface of insulating member 51, in a range between housing-side joining portion 512 and terminal-side joining portion 513, insulation securing portions 514 are provided. In the present exemplary embodiment, insulation securing portion 514 is provided at each of inner side surface 503 and outer side surface 504 of insulating member 51. That is, housing-side joining portion 512 provided at lower surface (first joining surface) 501 of insulating member 51 and terminal-side joining portion 513 provided at upper surface (second joining surface) 502 of insulating member 51 are separated from each other by insulation securing portions 514 on the surface of insulating member 51. In the present exemplary embodiment, as an example, substantially the entire inner side surface 503 and outer side surface 504 including the chamfered portions structure insulation securing portions 514.

Here, at least one of housing-side joining portion 512 and terminal-side joining portion 513 is provided with metal layer 515 at its surface. That is, in the surface of non-metal made (herein, ceramic-made) insulating member 51, the site corresponding to at least one of housing-side joining portion 512 and terminal-side joining portion 513 is metallized by metallizing. Metallizing is performed by, for example, applying metal paste onto the surface of insulating member 51 with a roller or a brush. In the present exemplary embodiment, both housing-side joining portion 512 and terminal-side joining portion 513 are subjected to metallizing, whereby metal layers 515 are formed. In this manner, by the joining portion of insulating member 51 (at least one of housing-side joining portion 512 and terminal-side joining portion 513) being subjected to metallizing, the joining strength between insulating member 51 and the metal member (housing 4, fixed terminal 31) improves.

The non-metalized sites in the surface of insulating member 51 structure insulation securing portions 514. Thus, insulation securing portions 514 become electrically insulating, and the creepage distance along the surface of insulating member 51 between housing-side joining portion 512 and terminal-side joining portion 513 is secured by insulation securing portions 514. Accordingly, the creepage distance between housing-side joining portion 512 and terminal-side joining portion 513 is substantially as great as the dimension (thickness dimension) of insulating member 51 in the penetrating direction (the top-bottom direction).

With insulating member 51 of such a structure, in the state where fixed terminal 31 is joined to housing 4 via insulating member 51, the creepage distance substantially as great as the thickness dimension of insulating member 51 is secured between housing 4 and fixed terminal 31.

(3) Structure of Electromagnet Device

As shown in FIG. 1, electromagnet device 10 has stator 12, armature 13, and excitation coil 14. In electromagnet device 10, a magnetic flux that occurs at excitation coil 14 upon energization attracts armature 13 to stator 12, whereby armature 13 shifts from a second position (the position shown in FIG. 1) to a first position.

Here, electromagnet device 10 has, in addition to stator 12, armature 13, and excitation coil 14, yoke 110 including yoke upper plate 11, shaft 15, holder 16, pressing spring 17, and return spring 18. Note that, electromagnet device 10 may have a coil bobbin made of synthetic resin, around which excitation coil 14 is wound.

Stator 12 is a fixed iron core that is formed to be circular tubular projecting downward from the center of the lower surface of yoke upper plate 11. The upper end of stator 12 is fixed to yoke upper plate 11.

Armature 13 is a movable iron core formed to be circular column-like, and disposed below stator 12 having its upper end surface opposed to the lower end surface of stator 12. Armature 13 is structured so as to be shiftable in the top-bottom direction. Armature 13 shifts between the first position where its upper end surface is in contact with the lower end surface of stator 12 and the second position where its upper end surface is spaced apart from the lower end surface of stator 12.

Excitation coil 14 is disposed below housing 4 having its center axis direction matched with the top-bottom direction. Inside excitation coil 14, stator 12 and armature 13 are disposed.

Yoke 110 is disposed so as to surround excitation coil 14, and forms, with stator 12 and armature 13, a magnetic circuit through which a magnetic flux occurring upon energization of excitation coil 14 passes. Accordingly, yoke 110, stator 12, and armature 13 are each made of a magnetic material. Yoke upper plate 11 structures part of this yoke 110. As described above, yoke upper plate 11 is joined to housing 4 so as to close the lower surface of housing (tubular portion 42) 4.

Return spring 18 is a coil spring that is disposed inside stator 12, and biases armature 13 downward (the second position).

Shaft 15 is formed with a non-magnetic material to be a circular rod that extends in the top-bottom direction. Shaft 15 transfers driving force that is generated by electromagnet device 10 to contact device 1 which is provided above electromagnet device 10. Shaft 15 is inserted into through hole 111 formed at the center portion of yoke upper plate 11. Shaft 15 passes through inside stator 12 and return spring 18, and has its lower end fixed to armature 13. Shaft 15 has its upper end fixed to holder 16 that holds movable contactor 8.

Holder 16 is, for example, a quadrangular tube whose opposite ends in the right-left direction are opened. Holder 16 is combined with movable contactor 8 while causing movable contactor 8 to penetrate therethrough. To holder 16, the upper end of shaft 15 is fixed. Pressing spring 17 is a coil spring that is disposed between the upper surface of the lower plate of holder 16 and the lower surface of movable contactor 8, and biases movable contactor 8 upward.

Thus, driving force that is generated by electromagnet device 10 is transferred to movable contactor 8 by shaft 15. As armature 13 shifts in the top-bottom direction, movable contactor 8 shifts in the top-bottom direction.

Note that, electromagnet device 10 may have a tubular body that is made of a non-magnetic material and houses stator 12 and armature 13. The tubular body is shaped to be a bottomed cylinder whose upper end is opened, and the upper end (the opening circumference portion) is joined to yoke upper plate 11. Thus, the tubular body limits the shifting direction of armature 13 to the top-bottom direction, and defines the second position of armature 13. Further, when contact device 1 is to have an airtight structure (that is, when the inner space of housing 4 is airtight space), the tubular body is desirably airtightly joined to the lower surface of yoke upper plate 11. Thus, despite the presence of through hole 111 at yoke upper plate 11, airtightness of the airtight space can be secured.

(4) Operation of Electromagnetic Relay

Next, a description will be briefly given of the operation of electromagnetic relay 100 including contact device 1 and electromagnet device 10 structured as described above.

When excitation coil 14 is not energized (a non-energized mode), since no magnetic attraction force occurs between armature 13 and stator 12, armature 13 is positioned at the second position by the spring force of return spring 18. At this time, as shown in FIG. 1, since holder 16 is pulled downward together with shaft 15, movable contactor 8 is restricted from shifting upward. Accordingly, movable contactor 8 causes a pair of movable contacts 81, 82 to be positioned at the open position where they are spaced apart from a pair of fixed contacts 311, 321. In this state, in contact device 1, since contact portions 21, 22 are in a state where they are open (hereinafter referred to as the "open state"), fixed terminals 31, 32 are not electrically connected to each other.

On the other hand, when excitation coil 14 is energized, since magnetic attraction force occurs between armature 13 and stator 12, armature 13 is pulled upward against the spring force of return spring 18, and shifts to the first position. Here, since holder 16 is upwardly pushed up together with shaft 15, movable contactor 8 is released from the restriction on upward shifting. Accordingly, movable contactor 8 causes the pair of movable contacts 81, 82 to be positioned at the closed position where they are in contact with the pair of fixed contacts 311, 321. In this state, in contact device 1, since contact portions 21, 22 are in the closed state, fixed terminals 31, 32 are electrically connected to each other.

In this manner, electromagnet device 10 switches the energized state of excitation coil 14 thereby controlling the attraction force that acts on armature 13. Thus, by armature 13 being caused to shift in the top-bottom direction, driving force for switching the open state and the closed state of contact portions 21, 22 of contact device 1 is generated.

(5) Effect

With contact device 1 according to the present exemplary embodiment as described above, fixed terminal 31 is held to housing 4 via annular insulating member 51. Accordingly, the present contact device 1 is advantageous in reducing variations in the position of fixed terminal 31 when housing 4 of relatively high dimensional precision is employed, as compared to the case where an insulating housing is employed.

That is, as an insulating housing employed for a contact device, in general, a ceramic-made housing is employed in order to secure insulation, heat resistance, and airtightness as necessary. In the present exemplary embodiment, use of insulating member 51 makes it possible to employ housing 4 of high dimensional precision. For example, metal-made housing 4 as described above is higher in dimensional precision than a ceramic-made housing. Therefore, variations in the position of fixed terminal 31 held to housing 4 can be reduced.

Further, insulating member 51 is joined to bottom plate 41 of housing 4 around opening hole 411. Accordingly, with contact device 1, provided that dimensional precision of insulating member 51 is low, adjusting the joining position (attaching position) of insulating member 51 relative to bottom plate 41 can reduce variations in the position of fixed terminal 31.

Further, insulating member 51 has housing-side joining portion 512 to which housing 4 is joined and terminal-side joining portion 513 to which fixed terminal 31 is joined. Then, in the surface of insulating member 51, at the positions where housing-side joining portion 512 and terminal-side joining portion 513 are spaced apart from each other, electrically insulating insulation securing portions 514 are provided. Thus, the creepage distance along the surface of insulating member 51 between housing 4 and fixed terminal 31 is secured by insulation securing portions 514. In sum, provision of insulation securing portions 514 at the surface of insulating member 51 advantageously improves insulating performance between housing 4 and fixed terminal 31, and the improved insulating performance contributes toward improving the pressure resistance of contact device 1.

Further, insulating member 51 is just required to have a shape and a dimension with which electrical insulation between fixed terminal 31 and housing 4 is secured. Accordingly, in the case where insulating member 51 is made of ceramic, by virtue of the ceramic-made component being simple and small in size, costs relating to a mold assembly and the material can be reduced and yields can be improved as compared to the case where a ceramic-made housing is employed.

Note that, though the material of insulating member 51 is not limited to aluminum oxide (alumina), use of aluminum oxide is advantageous in that relatively high electrical insulation, resistance to arc, and airtightness are realized.

Further, as in the present exemplary embodiment, preferably inner diameter φ1 of insulating member 51 is set to be greater than outer diameter 2 of fixed terminal 31, such that clearance g1 is formed between inner side surface (inner circumferential surface) 503 of insulating member 51 and the outer side surface (outer circumferential surface) of fixed terminal 31. With this structure, there is a margin of adjusting the position of fixed terminal 31 inside insulating member 51 (inside hollow portion 511) within a range of clearance g1. Accordingly, provided that the dimensional precision of insulating member 51 is low, variations in the position of fixed terminal 31 relative to housing 4 can be easily reduced. This structure is not essential, and whether or not to employ this structure should be arbitrarily determined.

Note that, contact device 1 is also advantageous in that electrical insulation between fixed terminal 31 and housing 4 can be surely secured by virtue of clearance g1 formed between inner side surface 503 of insulating member 51 and the outer side surface of fixed terminal 31. That is, with contact device 1, as contact portions 21, 22 open and close, flying such as metal powder may fly from contact portions 21, 22, and the flying may attach to insulating member 51. However, with contact device 1 according to the present exemplary embodiment, clearance g1 between insulating member 51 and fixed terminal 31 secures insulation between fixed terminal 31 and housing 4 even when any flying attach to insulating member 51.

Further, as in the present exemplary embodiment, preferably two or more opening holes 411, 412 are formed at housing 4, and fixed terminals 31, 32 and insulating members 51, 52 are provided as many as opening holes 411, 412, respectively so as to be in a one-to-one relationship with opening holes 411, 412. With this structure, the reduced variations in the positions of a pair of fixed terminals 31, 32 relative to housing 4 also reduce variations in the distance between the pair of fixed terminals 31, 32. In other words, dimensional precision of the distance between the pair of fixed terminals 31, 32 advantageously improves.

Further, in the case where there are a plurality of specifications as to contact device 1 differing in the distance between the pair of fixed terminals 31, 32 by the rated insulation voltage or the like, insulating members 51, 52 can be advantageously used in common components among such a plurality of specifications. That is, contact device 1 with different distance between the pair of fixed terminals 31, 32 can be realized by simply changing the distance between a pair of opening holes 411, 412 formed at housing 4 while employing identical insulating members 51, 52.

Still further, in the present exemplary embodiment, housing 4 is preferably made of metal. This structure is advantageous in that housing 4 of high dimensional precision can be implemented with simpler work as compared to the case where housing 4 is made of a non-metal material. Note that, this structure is not essential, and whether or not to employ this structure should be arbitrarily determined.

In the case where housing 4 is made of metal, as in the present exemplary embodiment, preferably metal-made housing-side spacer 71 is provided between insulating member 51 and bottom plate 41, and housing-side joining portion 512 of insulating member 51 is joined to bottom plate 41 via housing-side spacer 71. With this structure, as compared to the case where insulating member 51 and bottom plate 41 are directly joined to each other, restriction on the material of bottom plate 41 is relaxed, and flexibility in selecting the material of bottom plate 41 improves.

In more detail, in the structure where insulating member 51 and bottom plate 41 are directly joined to each other, for example, when insulating member 51 is made of ceramic and bottom plate 41 is made of metal, insulating member 51 and bottom plate 41 are joined to each other by brazing. In the process of brazing, insulating member 51 and bottom plate 41 are placed in a high-temperature environment. Accordingly, in general, bottom plate 41 is made of a metal material (Alloy 42 or Kovar) whose thermal coefficient of expansion is close to that of insulating member (ceramic) 51.

In contrast, in the structure of the present exemplary embodiment, insulating member 51 and housing-side spacer 71 are brazed to each other. Accordingly, it is just required that housing-side spacer 71 is made of a metal material whose thermal coefficient of expansion is close to that of insulating member 51. Thus, contact device 1 according to the present exemplary embodiment is advantageous in that, by virtue of including housing-side spacer 71, restriction on the material of bottom plate 41 is relaxed, and flexibility in selecting the material of bottom plate 41 improves. Note that, this structure is not essential, and whether or not to employ this structure should be arbitrarily determined.

Further, in the case where housing 4 is made of metal, as in the present exemplary embodiment, in housing 4, preferably at least bottom plate 41 and the site other than bottom plate 41 (tubular portion 42) are separate members. In this structure, it is just required that, in housing 4, just bottom plate 41 that holds fixed terminal 31 is made of a metal material (Alloy 42 or Kovar) whose thermal coefficient of expansion is close to that of insulating member (ceramic) 51. Accordingly, the site in housing 4 other than bottom plate 41 (tubular portion 42) may be made of a material exhibiting excellent workability such as stainless steel (SUS304), for example. Thus, as compared to the case where housing 4 is entirely made of Alloy 42 or Kovar, the yield from drawing improves. Note that, this structure is not essential, and whether or not to employ this structure should be arbitrarily determined.

Still further, as in the present exemplary embodiment, preferably metal-made terminal-side spacer 61 is provided between fixed terminal 31 and insulating member 51, and fixed terminal 31 is joined to terminal-side joining portion 513 of insulating member 51 via terminal-side spacer 61. This structure improves the flexibility in selecting the material and shape of fixed terminal 31 as compared to the structure in which fixed terminal 31 and insulating member 51 are directly joined to each other. Note that, this structure is not essential, and whether or not to employ this structure should be arbitrarily determined.

Still further, housing-side joining portion 512 is preferably provided at one end surface (lower surface 501) in the penetrating direction (the top-bottom direction) of insulating member 51 and terminal-side joining portion 513 is provided at other end surface (upper surface 502) in the penetrating direction of insulating member 51. With this structure, since inner side surface 503 and outer side surface 504 of insulating member 51 serve as insulation securing portions 514, the creepage distance between housing-side joining portion 512 and terminal-side joining portion 513 becomes substantially as great as the dimension (thickness dimension) of insulating member 51 in the penetrating direction (the top-bottom direction). Accordingly, despite the reduced dimension of insulating member 51 in a plane perpendicular to the penetrating direction, a great creepage distance between housing 4 and fixed terminal 31 can be provided. Note that, this structure is not essential, and whether or not to employ this structure should be arbitrarily determined.

Still further, as in the present exemplary embodiment, preferably metal layer 515 is formed at the surface of at least one of housing-side joining portion 512 and terminal-side joining portion 513. With this structure, for example in the case where insulating member 51 is made of ceramic and housing 4 or fixed terminal 31 is made of metal, the joining strength between insulating member 51 and housing 4 or fixed terminal 31 improves. That is, by virtue of metal layer 515 being formed at the joining portion of insulating member 51 (at least one of housing-side joining portion 512 and terminal-side joining portion 513), joining between insulating member 51 and the metal members (housing 4, fixed terminal 31) is realized by joining between the metal materials. Thus, the joining strength improves. Note that, this structure is not essential, and whether or not to employ this structure should be arbitrarily determined.

Still further, as in the present exemplary embodiment, preferably fixed terminal 31 is airtightly joined to insulating member 51 and insulating member 51 is airtightly joined to bottom plate 41 so that the inner space of housing 4 becomes airtight space. With this structure, since contact portions 21, 22 are housed in the airtight space, contact device 1 can be used in various atmospheres. With contact device 1, it is also possible to improve the arc-extinguishing performance by enclosing arc-extinguishing gas in the inner space of housing 4. Note that, this structure is not essential, and whether or not to employ this structure should be arbitrarily determined.

Still further, electromagnetic relay 100 according to the present exemplary embodiment includes contact device 1 and electromagnet device 10 that drives to open and close contact portions 21, 22 as described above. Accordingly, electromagnetic relay 100 is advantageous in reducing variations in the position of fixed terminal 31 when housing 4 of relatively high dimensional precision is employed in contact device 1, as compared to the case where an insulating housing is employed.

(6) Variation

As Variation of the first exemplary embodiment, contact device 1 may not include terminal-side spacer 61 (see FIG. 1).

Figure 5:
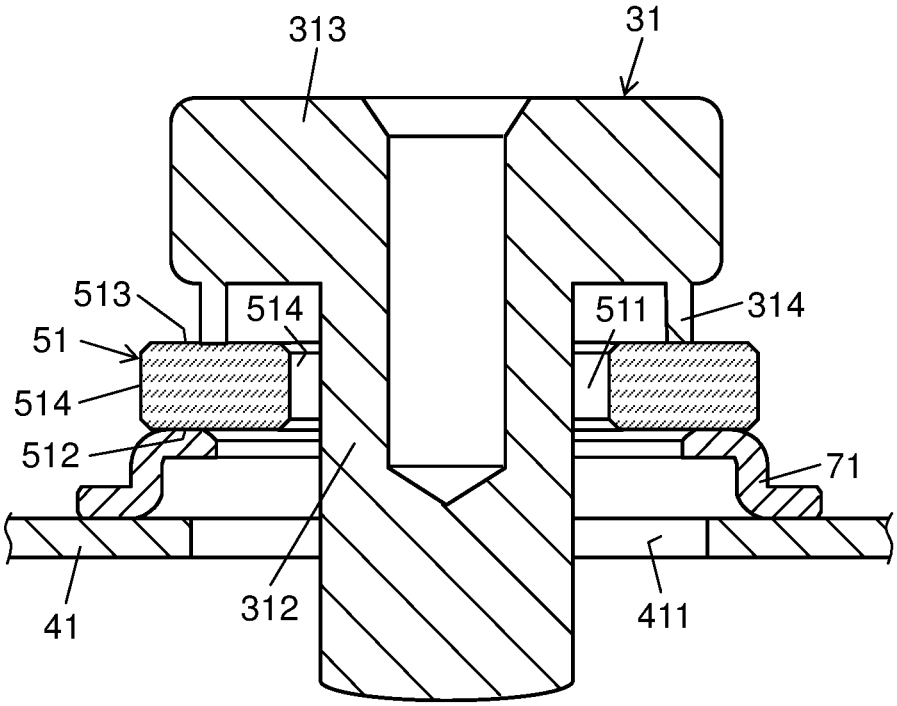
FIG. 5 is a cross-sectional view showing the main part of a contact device according to Variation of the first exemplary embodiment.

In contact device 1 of the present Variation, as shown in FIG. 5, fixed terminal 31 has annular leg portion 314 that projects downward from the lower surface of increased-diameter portion 313 along the outer circumferential surface of small-diameter portion 312. Here, the inner diameter of leg portion 314 is set to be greater than the inner diameter of insulating member 51, and to be smaller than the outer diameter of insulating member 51.

Fixed terminal 31 has the tip (lower end) of leg portion 314 directly joined to terminal-side joining portion 513 of insulating member 51 in the state where the tip surface (the lower end surface) of leg portion 314 is in contact with terminal-side joining portion 513 provided at the upper surface of insulating member 51. Thus, fixed terminal 31 is directly fixed to insulating member 51. Fixed terminal 31 and terminal-side joining portion 513 of insulating member 51 are joined to each other by brazing.

Further, in the present Variation, the shape of housing-side spacer 71 is different from that in the first exemplary embodiment. In the present Variation, as shown in FIG. 5, in housing-side spacer 71, there exists a step difference between the inner circumferential portion and the outer circumferential portion so that a height from bottom plate 41 becomes higher at the inner circumferential portion than at the outer circumferential portion. In the state where housing-side joining portion 512 provided at the lower surface of insulating member 51 is in contact with the inner circumferential portion at the upper surface of housing-side spacer 71, insulating member 51 is indirectly fixed to housing 4 via housing-side spacer 71.

With the structure of the present Variation described above, since terminal-side spacer 61 is not included, the number of components of contact device 1 can be reduced as compared to the structure of the first exemplary embodiment. Still further, in this case, preferably fixed terminal 31 has leg portion 314 as described above, and the tip of leg portion 314 is joined to insulating member 51. Thus, terminal-side joining portion 513 is just required to be the site in the upper surface of insulating member 51 where the tip of leg portion 314 is in contact with. That is, as compared to the case where terminal-side spacer 61 or fixed terminal 31 is in surface contact with insulating member 51, the smaller surface of terminal-side joining portion 513 will suffice. As a result, a greater insulation distance (the creepage distance) between terminal-side joining portion 513 and housing-side joining portion 512 can be provided. Further, the range in insulating member 51 subjected to metallizing can be reduced.

Further, an insulating material with which insulating member 51 is made may be, for example, any ceramic other than the above-described aluminum oxide (alumina), such as aluminum nitride or silicon nitride. When aluminum nitride is employed as the material of insulating member 51, relatively higher thermal conductivity and airtightness are realized. On the other hand, when silicon nitride is employed as the material of insulating member 51, relatively higher thermal shock resistance and airtightness are realized. Further, the material of insulating member 51 may be an insulating material other than ceramic and glass. For example, employing synthetic resin such as epoxy resin improves flexibility in selecting the shape of insulating member 51, and also contributes toward reducing costs.

Still further, in connection with insulating member 51, at least insulation securing portion 514 should be electrically insulating, and the structure in which the entire insulating member 51 is made of an insulating material is not essential. For example, insulating member 51 may be structured by a conductive metal member having its surface covered with an insulating material, or may be hollow. In the case where the surface is covered with an insulating material, for example, a thin film such as a DLC (Diamond Like Carbon) thin film or a metal oxide film is used. A DLC thin film is advantageous in being chemically stable and highly airtight.

Second Exemplary Embodiment

Contact device 1 according to the present exemplary embodiment is different from contact device 1 according to the first exemplary embodiment in that opposite end surfaces (lower surface 501 and upper surface 502) in the penetrating direction (the top-bottom direction) of insulating member 51 are not flat. In the following, the structure similar to that in the first exemplary embodiment is denoted by the identical reference character, and the description thereof is omitted as appropriate. Note that, in the present exemplary embodiment, a description will be given on the premise that, except for insulating member 51, the structure shown in FIG. 5 and described as Variation of the first exemplary embodiment is employed. However, the present exemplary embodiment is not limited thereto and the structure shown in FIG. 1 may be employed.

In the following, as specific exemplary structures of insulating member 51 according to the present exemplary embodiment, first to fourth exemplary structures will be described.

(1) First Exemplary Structure

Figure 6A:
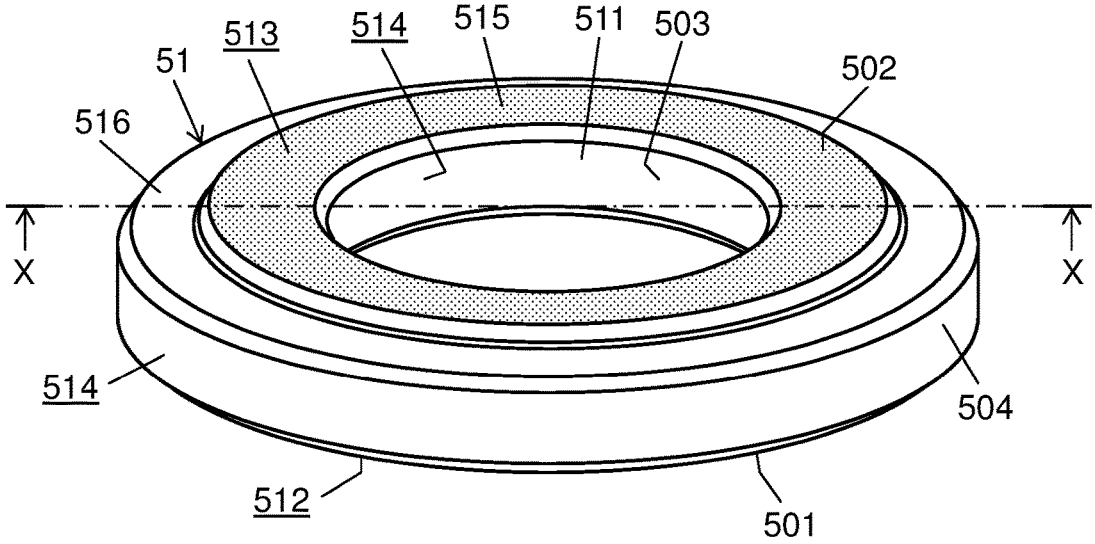
FIG. 6A is a perspective view showing an insulating member according to a first exemplary structure of a second exemplary embodiment.
Figure 6B:
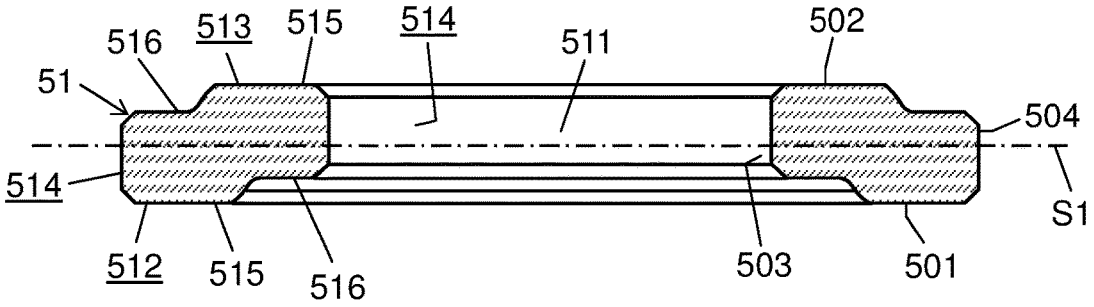
FIG. 6B is a cross-sectional view taken along line X-X in FIG. 6A.

In insulating member 51 according to a first exemplary structure, as shown in FIGS. 6A and 6B, insulation securing portions 514 are provided respectively from inner side surface 503 and outer side surface 504 of insulating member 51 to opposite end surfaces (lower surface 501 and upper surface 502) in the penetrating direction (the top-bottom direction). Note that, lower surface 501 and upper surface 502 of insulating member 51 are provided with housing-side joining portion 512 and terminal-side joining portion 513, respectively. Accordingly, insulation securing portions 514 are not formed at the entire lower surface 501 and the entire upper surface 502 of insulating member 51, but formed at portions excluding housing-side joining portion 512 and terminal-side joining portion 513. Here, in lower surface 501 and upper surface 502 of insulating member 51, portions each provided with metal layer 515 at the surface respectively structure housing-side joining portion 512 and terminal-side joining portion 513, and the remainder structures insulation securing portions 514.

In the first exemplary structure, each insulation securing portion 514 includes, on one of the opposite end surfaces in the penetrating direction of insulating member 51 in which one surface is provided with at least one of housing-side joining portion 512 and terminal-side joining portion 513, recessed portion 516 that is formed so as to surround hollow portion 511 (the first region). Recessed portion 516 is recessed in the direction in which dimension in the penetrating direction of insulating member 51 becomes smaller (toward reference surface S1 side) as compared to one of housing-side joining portion 512 and terminal-side joining portion 513 in which one joining portion is provided at a surface identical to recessed portion 516. As used herein, reference surface S1 is a virtual plane that passes through the center in the penetrating direction of insulating member 51 and that is perpendicular to the penetrating direction.

That is, recessed portion 516 is formed at least one of opposite end surfaces (lower surface 501 and upper surface 502) in the penetrating direction of insulating member 51 in which one surface is provided with one of housing-side joining portion 512 and terminal-side joining portion 513. In the present exemplary embodiment, housing-side joining portion 512 and terminal-side joining portion 513 are respectively provided at opposite end surfaces (lower surface 501 and upper surface 502) in the penetrating direction of insulating member 51. Accordingly, recessed portion 516 is provided to each of the opposite end surfaces (lower surface 501 and upper surface 502) in the penetrating direction of insulating member 51. In the present exemplary embodiment, insulating member 51 is annularly formed, with hollow portion 511 circularly opened on the inner side of insulating member 51. Accordingly, recessed portions 516 formed so as to surround hollow portion 511 become annular in a plan view.

Further, in the first exemplary structure, recessed portion 516 formed at a surface identical to housing-side joining portion 512, that is, recessed portion 516 formed at lower surface 501 of insulating member 51 is formed along the circumference of lower surface 501 on the inner side surface 503 side (the inner circumference). In other words, as shown in FIG. 6B, lower surface 501 of insulating member 51 is split into the outer circumference side and the inner circumference side, and the height from reference surface S1 is smaller on the inner circumference side than on the outer circumference side. This portion with the smaller height structures recessed portion 516. On the other hand, recessed portion 516 formed at a surface identical to terminal-side joining portion 513, that is, recessed portion 516 formed at upper surface 502 of insulating member 51 is formed along the circumference of upper surface 502 on outer side surface 504 side (the outer circumference). In other words, as shown in FIG. 6B, upper surface 502 of insulating member 51 is split into the outer circumference side and the inner circumference side, and the height from reference surface S1 is smaller on the outer circumference side than on the inner circumference side. This portion with the smaller height structures recessed portion 516. Thus, housing-side joining portion 512 is provided on the outer circumference side of lower surface 501 of insulating member 51, and terminal-side joining portion 513 is provided on the inner circumference side of upper surface 502 of insulating member 51. Accordingly, as shown in FIG. 6B, housing-side joining portion 512 and terminal-side joining portion 513 diagonally oppose to each other in a substantial quadrangle surrounded by lower surface 501, upper surface 502, inner side surface 503, and outer side surface 504 in a cross section of insulating member 51.

In the first exemplary structure described above, insulation securing portions 514 are respectively provided from inner side surface 503 and outer side surface 504 of insulating member 51 to the opposite end surfaces (lower surface 501 and upper surface 502) in the penetrating direction (the top-bottom direction). Thus, as compared to the structure in which insulation securing portions 514 are provided to just inner side surface 503 and outer side surface 504 of insulating member 51, the creepage distance between housing-side joining portion 512 and terminal-side joining portion 513 becomes greater, whereby the insulating performance between housing 4 and fixed terminal 31 improves.

In addition, each insulation securing portion 514 includes, on one of the opposite end surfaces in the penetrating direction of insulating member 51 in which one surface is provided with at least one of housing-side joining portion 512 and terminal-side joining portion 513, recessed portion 516 that is formed so as to surround hollow portion 511. Accordingly, in the case where insulating member 51 is in surface contact with housing 4 and fixed terminal 31 also, a clearance is formed between the bottom surface of recessed portion 516 and housing 4 and between the bottom surface of recessed portion 516 and fixed terminal 31. Accordingly, at portions of insulation securing portions 514 where recessed portions 516 are formed, housing 4 and fixed terminal 31 are prevented from being brought into contact with insulation securing portions 514. Thus, as compared to the case where recessed portions 516 are not provided, the creepage distance between housing 4 and fixed terminal 31 becomes greater, whereby the insulating performance between housing 4 and fixed terminal 31 improves. Further, as compared to the case where recessed portions 516 are not provided, the volume of insulating member 51 becomes smaller. This reduces the material required to manufacture one piece of insulating member 51, while ensuring the creepage distance between housing-side joining portion 512 and terminal-side joining portion 513.

Further, since recessed portions 516 are at positions lower than housing-side joining portion 512 and terminal-side joining portion 513 (the height from reference surface S1 is low), the work of metallizing housing-side joining portion 512 and terminal-side joining portion 513 is facilitated. In sum, while metallizing is performed by, for example applying metal paste onto the surface of insulating member 51 with a roller or a brush, the metal paste is less prone to attach to recessed portions 516 which are lowered from housing-side joining portion 512 and terminal-side joining portion 513. Accordingly, the work of forming metal layers 515 respectively at the surface of housing-side joining portion 512 and the surface of terminal-side joining portion 513 becomes easier.

Further, as in the first exemplary structure, preferably housing-side joining portion 512 and terminal-side joining portion 513 diagonally oppose to each other in a substantial quadrangle surrounded by lower surface 501, upper surface 502, inner side surface 503, and outer side surface 504 in a cross section of insulating member 51. With this structure, as compared to the case where housing-side joining portion 512 and terminal-side joining portion 513 are both positioned on the inner circumference side or on the outer circumference side, the creepage distance between housing-side joining portion 512 and terminal-side joining portion 513 becomes greater, whereby the insulating performance between housing 4 and fixed terminal 31 improves.

(2) Second Exemplary Structure

Figure 7A:
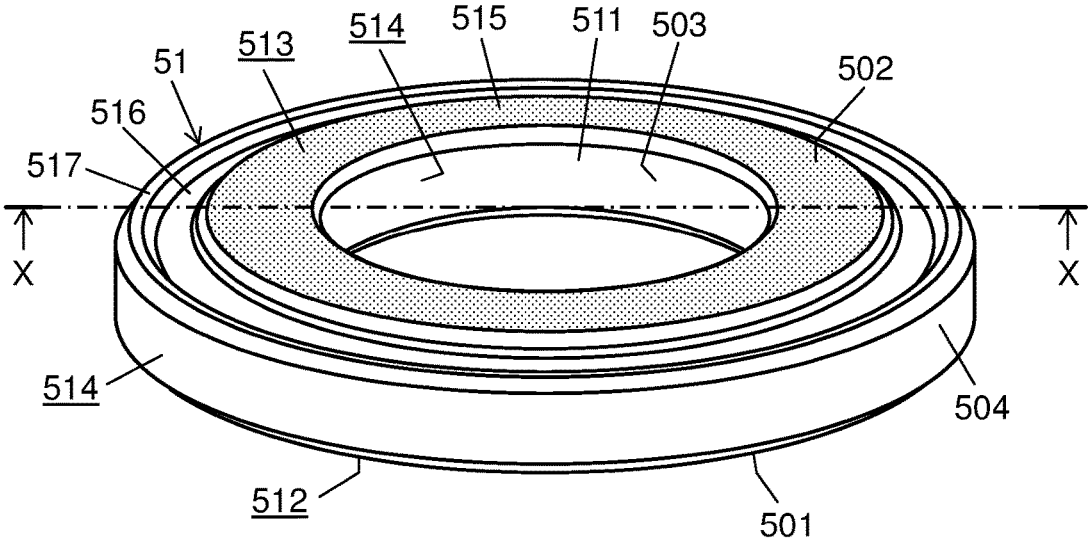
FIG. 7A is a perspective view showing an insulating member according to a second exemplary structure of the second exemplary embodiment.
Figure 7B:
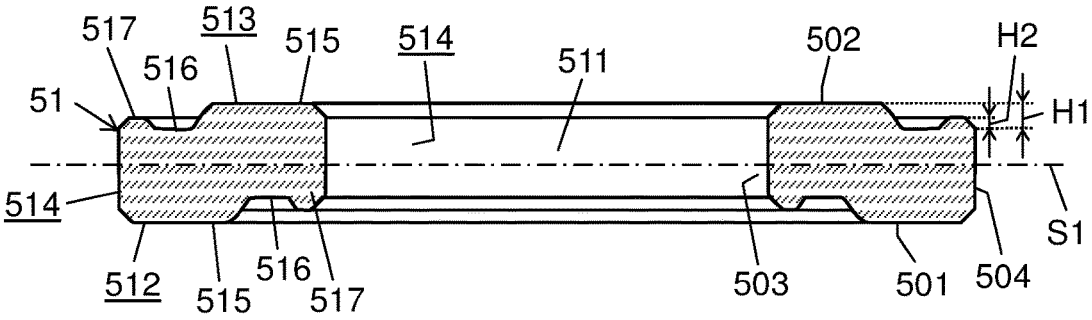
FIG. 7B is a cross-sectional view taken along line X-X in FIG. 7A.

As shown in FIGS. 7A and 7B, insulating member 51 according to a second exemplary structure has a structure in which (first) protruding portions 517 are added to insulating member 51 according to the first exemplary structure. In the following, the structure similar to that in the first exemplary structure is denoted by the identical reference character, and the description thereof is omitted as appropriate.

(First) protruding portion 517 is formed so as to surround hollow portion 511 at the bottom surface of each recessed portion 516. Protruding portion 517 projects in the direction in which the dimension in the penetrating direction (the top-bottom direction) of insulating member 51 increases (in the direction opposite to reference surface S1) as compared to other site other than protruding portion 517 at the bottom surface of recessed portion 516.

In the second exemplary structure, protruding portion 517 is provided at each of recessed portions 516 respectively formed at opposite end surfaces (lower surface 501 and upper surface 502) in the penetrating direction of insulating member 51. In the present exemplary embodiment, insulating member 51 is annularly formed, with hollow portion 511 circularly opened on the inner side of insulating member 51. Accordingly, protruding portions 517 formed so as to surround hollow portion 511 become annular in a plan view.

Further, in the second exemplary structure, protruding portion 517 formed at a surface identical to housing-side joining portion 512, that is, protruding portion 517 formed at lower surface 501 of insulating member 51 is formed along the circumference of lower surface 501 on the inner side surface 503 side (the inner circumference). Accordingly, at lower surface 501 of insulating member 51, an annular groove is formed between housing-side joining portion 512 and protruding portion 517. On the other hand, protruding portion 517 formed at a surface identical to terminal-side joining portion 513, that is, protruding portion 517 formed at upper surface 502 of insulating member 51 is formed along the circumference of upper surface 502 on outer side surface 504 side (the outer circumference). Accordingly, at upper surface 502 of insulating member 51, an annular groove is formed between terminal-side joining portion 513 and protruding portion 517.

Further, in the second exemplary structure, as shown in FIG. 7B, dimension (height) H2 in the penetrating direction (the top-bottom direction) of protruding portion 517 is set to be smaller than depth H1 of recessed portion 516 (H1>H2). In other words, protruding portion 517 is set to have a height accommodated in recessed portion 516. Accordingly, at lower surface 501 of insulating member 51, as seen from reference surface S1, the tip of protruding portion 517 is at a position lower than housing-side joining portion 512. Similarly, at upper surface 502 of insulating member 51, as seen from reference surface S1, the tip of protruding portion 517 is at a position lower than terminal-side joining portion 513.

In other words, in the penetrating direction, dimension (H2) from the bottom surface of recessed portion 516 to the tip of protruding portion 517 is smaller than dimension (H1) from the bottom surface of recessed portion 516 to upper surface 502 of (first) insulating member 51.

Note that, while the description has been given of recessed portion 516 and protruding portion 517 formed at upper surface 502 of insulating member 51, the same holds true for recessed portion 516 and protruding portion 517 formed at lower surface 501 of insulating member 51. The dimension from the bottom surface of recessed portion 516 to the tip of protruding portion 517 is smaller than the dimension from the bottom surface of recessed portion 516 to lower surface 501 of (first) insulating member 51.

With the second exemplary structure described above, since protruding portions 517 are respectively formed at the bottom surfaces of recessed portions 516, on the surface of insulating member 51, protruding portions 517 are interposed between housing-side joining portion 512 and terminal-side joining portion 513. Thus, with the same thickness dimension of insulating member 51, the creepage distance between housing-side joining portion 512 and terminal-side joining portion 513 becomes greater by the amount of protruding portions 517, as compared to the case where the bottom surfaces of recessed portions 516 are flat. Thus, the insulating performance between housing 4 and fixed terminal 31 improves. Accordingly, the insulating performance between housing 4 and fixed terminal 31 improves despite the reduced dimension in the penetrating direction (the thickness dimension) of insulating member 51, whereby the voltage resistance of contact device 1 advantageously improves. With the second exemplary structure, the creepage distance between housing-side joining portion 512 and terminal-side joining portion 513 becomes greater by an amount twice as great as height H2 of protruding portion 517.

Further, as in the second exemplary structure, preferably dimension H2 in the penetrating direction of protruding portion 517 is smaller than depth H1 of recessed portion 516. With this structure, similarly to the first exemplary structure, in the case where insulating member 51 is in surface contact with housing 4 and fixed terminal 31 also, the creepage distance between housing 4 and fixed terminal 31 becomes great. That is, in the case where insulating member 51 is in surface contact with housing 4 and fixed terminal 31 also, a clearance is formed between the tip of protruding portion 517 and housing 4 and between the tip of protruding portion 517 and fixed terminal 31. This prevents housing 4 and fixed terminal 31 from being brought into contact with insulation securing portions 514. Thus, as compared to the case where housing 4 and fixed terminal 31 are in contact with insulation securing portions 514, the creepage distance between housing 4 and fixed terminal 31 becomes greater, whereby the insulating performance between housing 4 and fixed terminal 31 improves. Further, similarly to the first exemplary structure, the work of metallizing housing-side joining portion 512 and terminal-side joining portion 513 is advantageously facilitated.

(3) Third Exemplary Structure

Figure 8A:
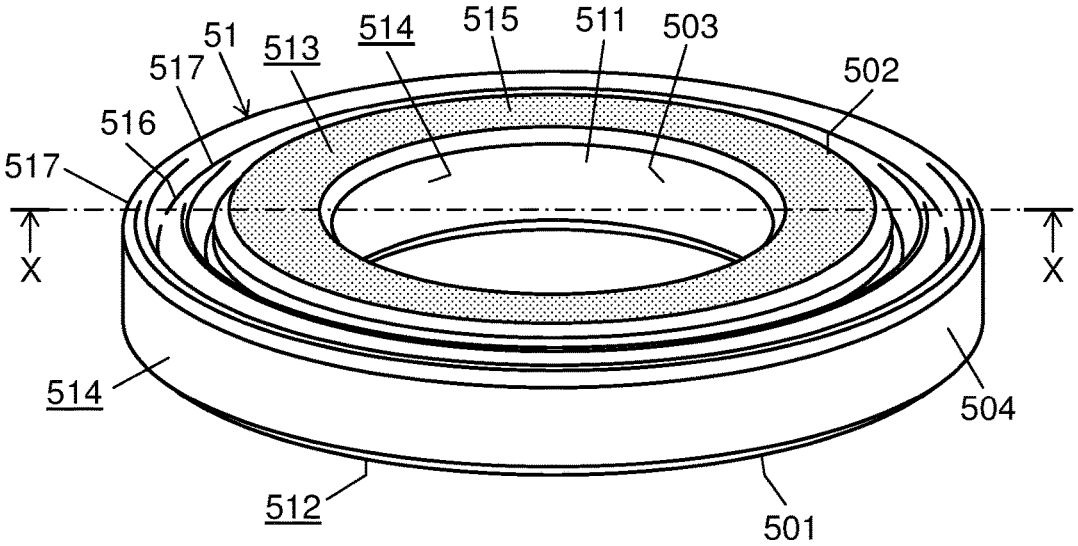
FIG. 8A is a perspective view showing an insulating member according to a third exemplary structure of the second exemplary embodiment.
Figure 8B:
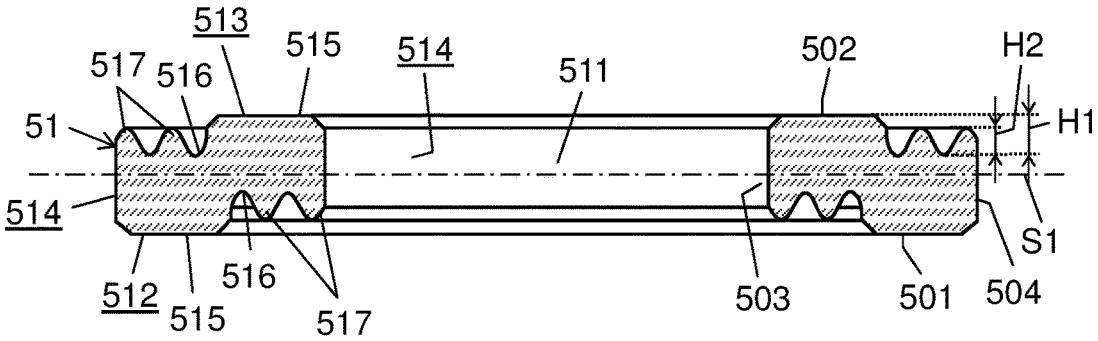
FIG. 8B is a cross-sectional view taken along line X-X in FIG. 8A.

As shown in FIGS. 8A and 8B, insulating member 51 according to a third exemplary structure is different from the second exemplary structure in that a plurality of (herein, two) (first) protruding portions 517 are provided so as to concentrically surround hollow portion 511 (the first region). In the following, the structure similar to that in the second exemplary structure is denoted by the identical reference character, and the description thereof is omitted as appropriate.

In the third exemplary structure, two (first) protruding portions 517 are provided at recessed portion 516 formed at each of opposite end surfaces (lower surface 501 and upper surface 502) in the penetrating direction of insulating member 51. In the present exemplary embodiment, insulating member 51 is annularly formed, with hollow portion 511 circularly opened on the inner side of insulating member 51. Accordingly, the plurality of protruding portions 517 provided so as to concentrically surround hollow portion 511 are concentrically formed in a plan view. Thus, lower surface 501 and upper surface 502 of insulating member 51 are each formed to be corrugated with the plurality of protruding portions 517.

Further, in the third exemplary structure, as shown in FIG. 8B, dimension (height) H2 in the penetrating direction (the top-bottom direction) of all protruding portions 517 is set to be smaller than depth H1 of recessed portion 516 (H1>H2). In other words, all protruding portions 517 are set to have a height accommodated in recessed portion 516.

In the third exemplary structure described above, since a plurality of protruding portions 517 are concentrically formed at the bottom surface of each recessed portion 516, on the surface of insulating member 51, the plurality of protruding portions 517 are interposed between housing-side joining portion 512 and terminal-side joining portion 513. Thus, as compared to the case where just a single protruding portion 517 is provided, the creepage distance between housing-side joining portion 512 and terminal-side joining portion 513 becomes further greater, whereby the insulating performance between housing 4 and fixed terminal 31 improves.

Further, as in the third exemplary structure, preferably dimension H2 in the penetrating direction of all protruding portions 517 is smaller than depth H1 of recessed portion 516. With this structure, similarly to the second exemplary structure, in the case where insulating member 51 is in surface contact with housing 4 and fixed terminal 31 also, the creepage distance between housing 4 and fixed terminal 31 becomes great. Further, similarly to the second exemplary structure, the work of metallizing housing-side joining portion 512 and terminal-side joining portion 513 is advantageously facilitated.

(4) Fourth Exemplary Structure

Figure 9A:
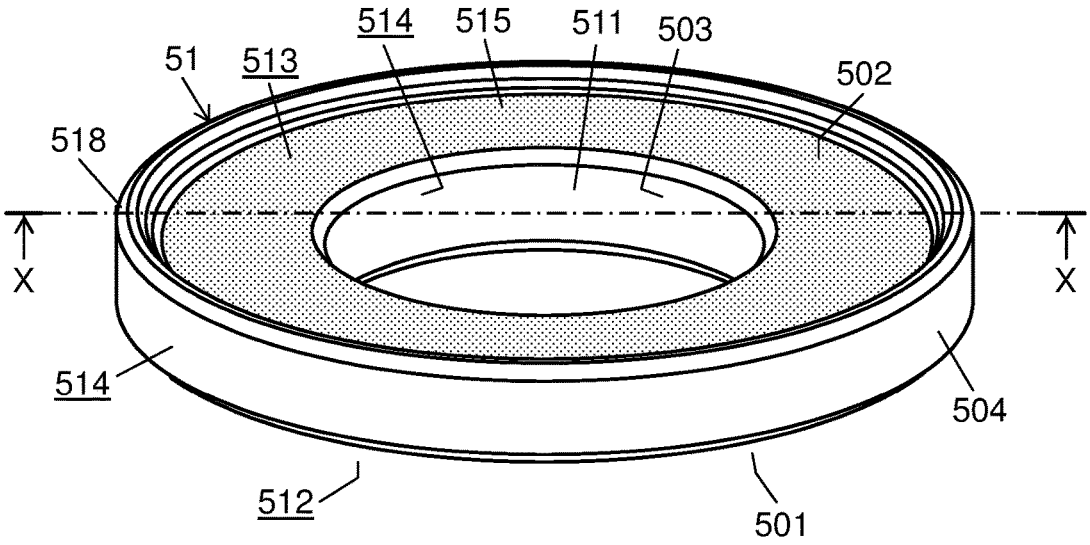
FIG. 9A is a perspective view showing an insulating member according to a fourth exemplary structure of the second exemplary embodiment.
Figure 9B:
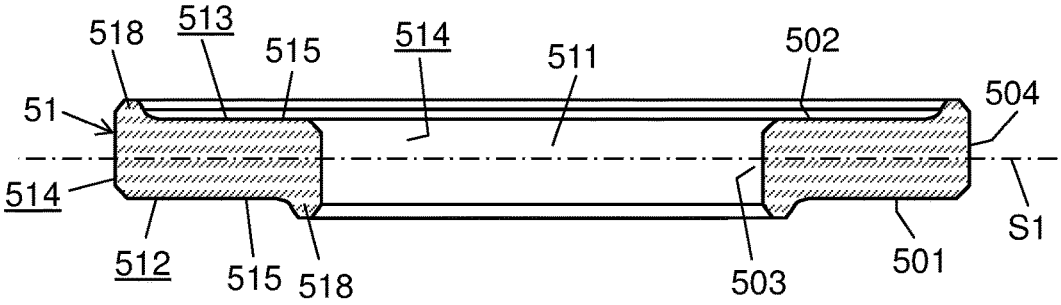
FIG. 9B is a cross-sectional view taken along line X-X in FIG. 9A.

As shown in FIGS. 9A and 9B, insulating member 51 according to a fourth exemplary structure is different from the first exemplary structure in that (second) protruding portions 518 are provided in place of recessed portions 516 (see FIGS. 6A and 6B). In the following, the structure similar to that in the first exemplary structure is denoted by the identical reference character, and the description thereof is omitted as appropriate.

In the fourth exemplary structure, each insulation securing portion 514 includes, on one of the opposite end surfaces in the penetrating direction of insulating member 51 in which one surface is provided with at least one of housing-side joining portion 512 and terminal-side joining portion 513, (second) protruding portion 518 that is formed so as to surround hollow portion 511. Protruding portion 518 projects in the direction in which dimension in the penetrating direction of insulating member 51 becomes greater (in the direction opposite to reference surface S1) as compared to one of housing-side joining portion 512 and terminal-side joining portion 513 in which one joining portion is provided at a surface identical to protruding portion 518.

That is, protruding portion 518 is formed at least one of opposite end surfaces in the penetrating direction of insulating member 51 in which one surface is provided with one of housing-side joining portion 512 and terminal-side joining portion 513. In the present exemplary embodiment, housing-side joining portion 512 and terminal-side joining portion 513 are respectively provided at opposite end surfaces in the penetrating direction of insulating member 51 (lower surface 501 and upper surface 502). Accordingly, protruding portion 518 is provided to each of the opposite end surfaces (lower surface 501 and upper surface 502) in the penetrating direction of insulating member 51. In the present exemplary embodiment, insulating member 51 is annularly formed, with hollow portion 511 circularly opened on the inner side of insulating member 51. Accordingly, protruding portions 518 formed so as to surround hollow portion 511 become annular in a plan view.

Further, in the fourth exemplary structure, protruding portion 518 formed at a surface identical to housing-side joining portion 512, that is, protruding portion 518 formed at lower surface 501 of insulating member 51 is formed along the circumference of lower surface 501 on the inner side surface 503 side (the inner circumference). In other words, as shown in FIG. 9B, lower surface 501 of insulating member 51 is split into the outer circumference side and the inner circumference side, and the height from reference surface S1 is greater on the inner circumference side than on the outer circumference side. This portion with the greater height structures protruding portion 518. On the other hand, protruding portion 518 formed at a surface identical to terminal-side joining portion 513, that is, protruding portion 518 formed at upper surface 502 of insulating member 51 is formed along the circumference of upper surface 502 on outer side surface 504 side (the outer circumference). In other words, as shown in FIG. 9B, upper surface 502 of insulating member 51 is split into the outer circumference side and the inner circumference side, and the height from reference surface S1 is greater on the outer circumference side than on the inner circumference side. This portion with the greater height structures protruding portion 518. Thus, housing-side joining portion 512 is provided on the outer circumference side of lower surface 501 of insulating member 51, and terminal-side joining portion 513 is provided on the inner circumference side of upper surface 502 of insulating member 51. Accordingly, as shown in FIG. 9B, housing-side joining portion 512 and terminal-side joining portion 513 diagonally oppose to each other in a substantial quadrangle surrounded by lower surface 501, upper surface 502, inner side surface 503, and outer side surface 504 in a cross section of insulating member 51.

In the fourth exemplary structure described above, each insulation securing portion 514 includes, on one of the opposite end surfaces in the penetrating direction of insulating member 51 in which one surface is provided with at least one of housing-side joining portion 512 and terminal-side joining portion 513, protruding portion 518 that is formed so as to surround hollow portion 511. Accordingly, on the surface of insulating member 51, protruding portions 518 are interposed between housing-side joining portion 512 and terminal-side joining portion 513. Thus, as compared to the case where protruding portions 518 are not provided, the creepage distance between housing-side joining portion 512 and terminal-side joining portion 513 becomes greater by the amount of protruding portions 518, whereby the insulating performance between housing 4 and fixed terminal 31 improves. With the fourth exemplary structure, the creepage distance between housing-side joining portion 512 and terminal-side joining portion 513 becomes greater by an amount twice as great as the height of each protruding portion 518.

(5) Variation

Insulating member 51 according to the present exemplary embodiment is not limited to the above-described structures, and for example as shown in FIGS. 10A to 10D, in each of the opposite end surfaces in the penetrating direction of insulating member 51, insulation securing portion 514 may be provided on each of both sides of the joining portion (housing-side joining portion 512, terminal-side joining portion 513). FIGS. 10A to 10D respectively show Variations of the first to fourth exemplary structures.

Figure 10A:
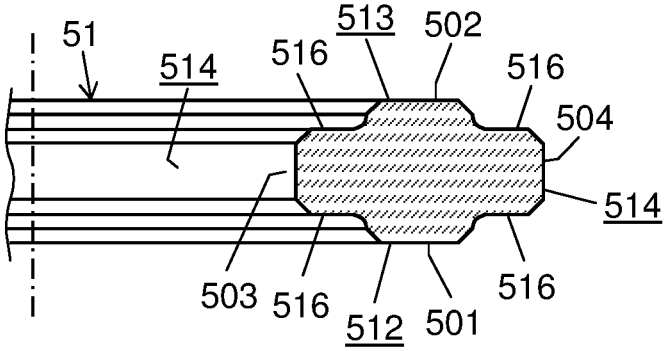
FIG. 10A is a cross-sectional view showing the main part of an insulating member according to Variation of the second exemplary embodiment.

That is, in the example shown in FIG. 10A, at lower surface 501 of insulating member 51, recessed portions 516 are respectively provided on both sides of housing-side joining portion 512. At upper surface 502 of insulating member 51, recessed portions 516 are respectively provided on both sides of terminal-side joining portion 513.

Figure 10B:
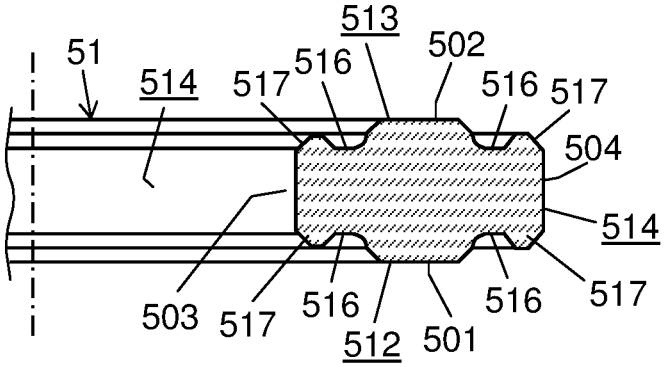
FIG. 10B is a cross-sectional view showing the main part of an insulating member according to Variation of the second exemplary embodiment.

In the example shown in FIG. 10B, at lower surface 501 of insulating member 51, protruding portions 517 are respectively provided on both sides of housing-side joining portion 512. At upper surface 502 of insulating member 51, protruding portions 517 are respectively provided on both sides of terminal-side joining portion 513.

Figure 10C:
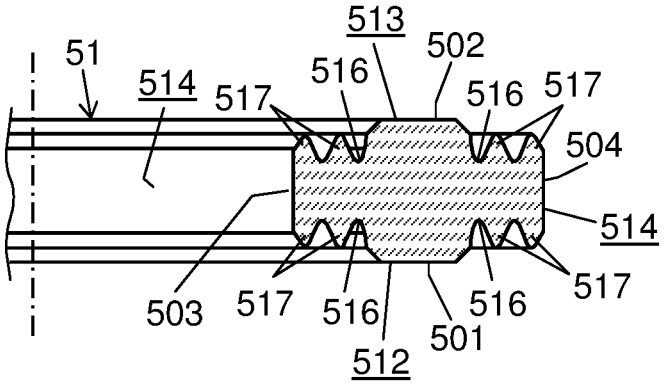
FIG. 10C is a cross-sectional view showing the main part of an insulating member according to Variation of the second exemplary embodiment.

In the example shown in FIG. 10C, at lower surface 501 of insulating member 51, a plurality of protruding portions 517 are provided at each of both sides of housing-side joining portion 512. At upper surface 502 of insulating member 51, a plurality of protruding portions 517 are provided at each of both sides of terminal-side joining portion 513.

Figure 10D:
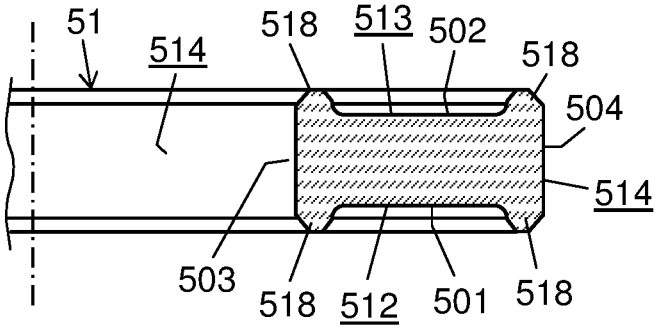
FIG. 10D is a cross-sectional view showing the main part of an insulating member according to Variation of the second exemplary embodiment.

In the example shown in FIG. 10D, at lower surface 501 of insulating member 51, protruding portions 518 are respectively provided on both sides of housing-side joining portion 512. At upper surface 502 of insulating member 51, protruding portions 518 are respectively provided on both sides of terminal-side joining portion 513. In other words, in the example shown in FIG. 10D, a plurality of protruding portions 518 are provided to concentrically surround hollow portion 511 at each of opposite end surfaces in the penetrating direction of insulating member 51.

Further, in the present exemplary embodiment, the first to fourth exemplary structures can be combined as appropriate. For example, the first exemplary structure may be employed for lower surface 501 of insulating member 51, and the second exemplary structure may be employed for upper surface 502 of insulating member 51.

Other structure and function are similar to those of the first exemplary embodiment.

Third Exemplary Embodiment

Contact device 1 according to the present exemplary embodiment is different from contact device 1 according to the first exemplary embodiment in that housing-side joining portion 512 is provided at outer side surface 504 of insulating member 51 and terminal-side joining portion 513 is provided at inner side surface 503 of insulating member 51. In the following, the structure similar to that in the first exemplary embodiment is denoted by the identical reference character, and the description thereof is omitted as appropriate. Note that, in the present exemplary embodiment, a description will be given on the premise that, except for the structure of insulating member 51, the structure of contact device 1 according to the first exemplary embodiment from which terminal-side spacer 61 (see FIG. 1) and housing-side spacer 71 (see FIG. 1) are omitted is employed.

In the present exemplary embodiment, insulating member 51 is a sealing glass for airtightly joining (sealing) between housing 4 and fixed terminal 31 while securing electrical insulation. That is, insulating member 51 is made of glass whose melting point is lower than that of housing 4 and fixed terminal 31. In a sealing step of joining fixed terminal 31 to housing 4, by being cured from a molten state, insulating member 51 joins fixed terminal 31 to housing 4. Note that, in the present exemplary embodiment, insulating member 51 is not subjected to metallizing and no metal layer is provided at the surface of housing-side joining portion 512 and terminal-side joining portion 513.

In the following, as specific exemplary structures of insulating member 51 according to the present exemplary embodiment, first to fourth exemplary structures will be described.

(1) First Exemplary Structure

Figure 11A:
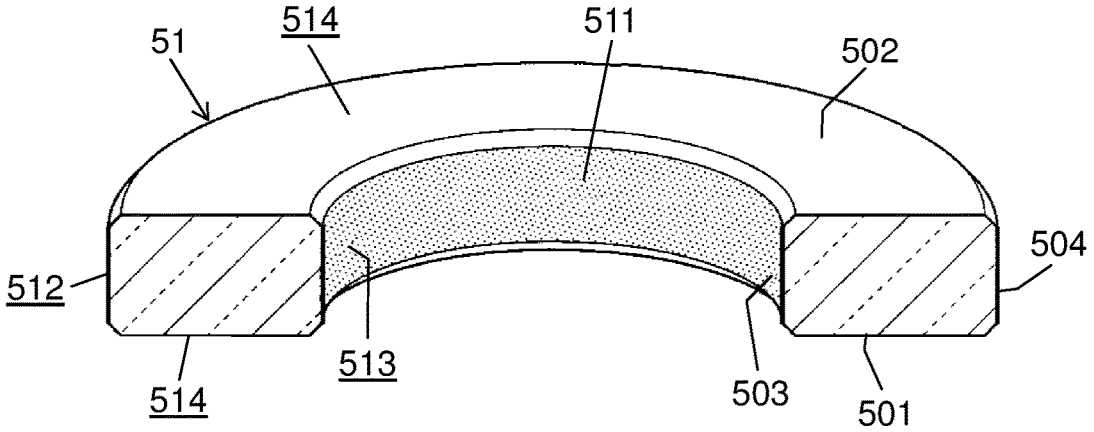
FIG. 11A is a cross-sectional perspective view showing an insulating member according to a first exemplary structure of a third exemplary embodiment.
Figure 11B:
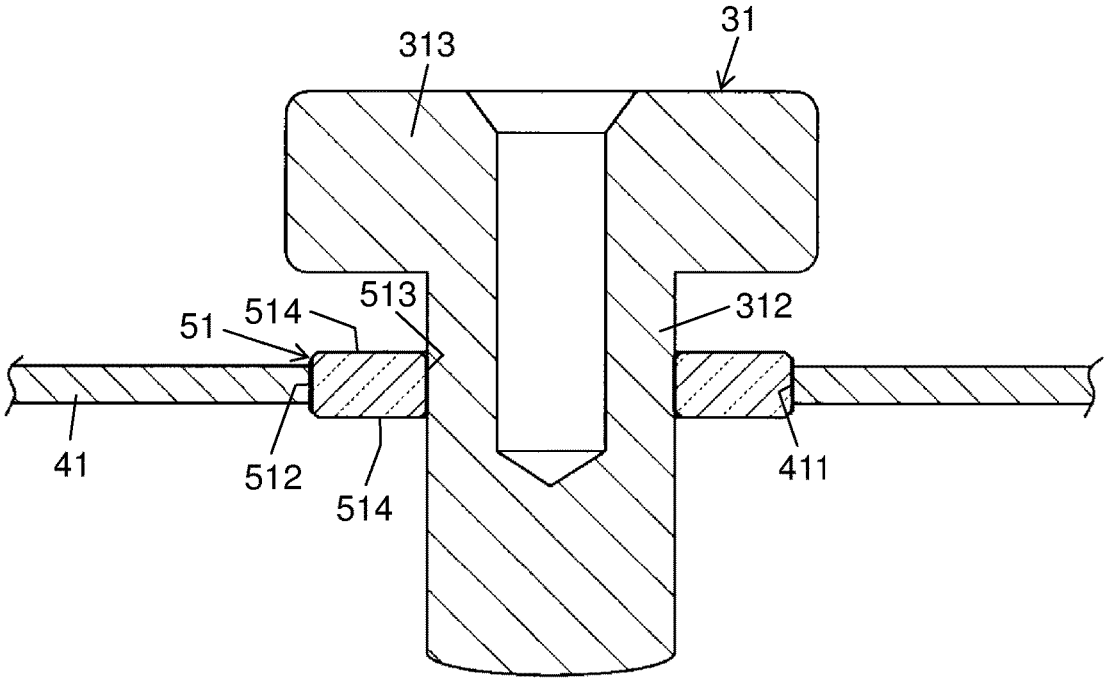
FIG. 11B is a cross-sectional view showing the main part of a contact device according to the first exemplary structure of the third exemplary embodiment.

In insulating member 51 according to a first exemplary structure, as shown in FIGS. 11A and 11B, insulation securing portion 514 is provided at each of opposite end surfaces (lower surface 501 and upper surface 502) of insulating member 51 in the penetrating direction (the top-bottom direction). In the first exemplary structure, insulating member 51 is provided to close the clearance between the inner circumferential surface of opening hole 411 at bottom plate 41 and the outer circumferential surface of small-diameter portion 312 of fixed terminal 31. That is, insulating member 51 is attached to housing 4 having its outer side surface 504 been in contact with housing (bottom plate 41) 4 and having its inner side surface 503 been in contact with fixed terminal 31.

Here, in outer side surface 504 of insulating member 51, a portion being in contact with housing (bottom plate 41) 4 structures housing-side joining portion 512, and in inner side surface 503 of insulating member 51, a portion being in contact with fixed terminal 31 structures terminal-side joining portion 513. Then, portions except for housing-side joining portion 512 and terminal-side joining portion 513 in outer side surface 504 and inner side surface 503 of insulating member 51, and the entire lower surface 501 and the entire upper surface 502 of insulating member 51 structure insulation securing portion 514.

In the first exemplary structure described above, at least the entire lower surface 501 and the entire upper surface 502 of insulating member 51 become insulation securing portions 514. Accordingly, the creepage distance between housing-side joining portion 512 and terminal-side joining portion 513 becomes equal to or greater than the dimension (width dimension) of the annular shape of insulating member 51. Accordingly, depending on the dimension of insulating member 51 within a plane perpendicular to the penetrating direction, a great creepage distance can be secured between housing 4 and fixed terminal 31. Further, with the first exemplary structure, the portion between housing 4 and fixed terminal 31 can be airtightly joined (sealed) while electrical insulation is secured, using the hermetic sealing technique for a general terminal. Further, since a terminal-side spacer and a housing-side spacer are not included, a reduction in the number of components can be achieved.

(2) Second Exemplary Structure

Figure 12A:
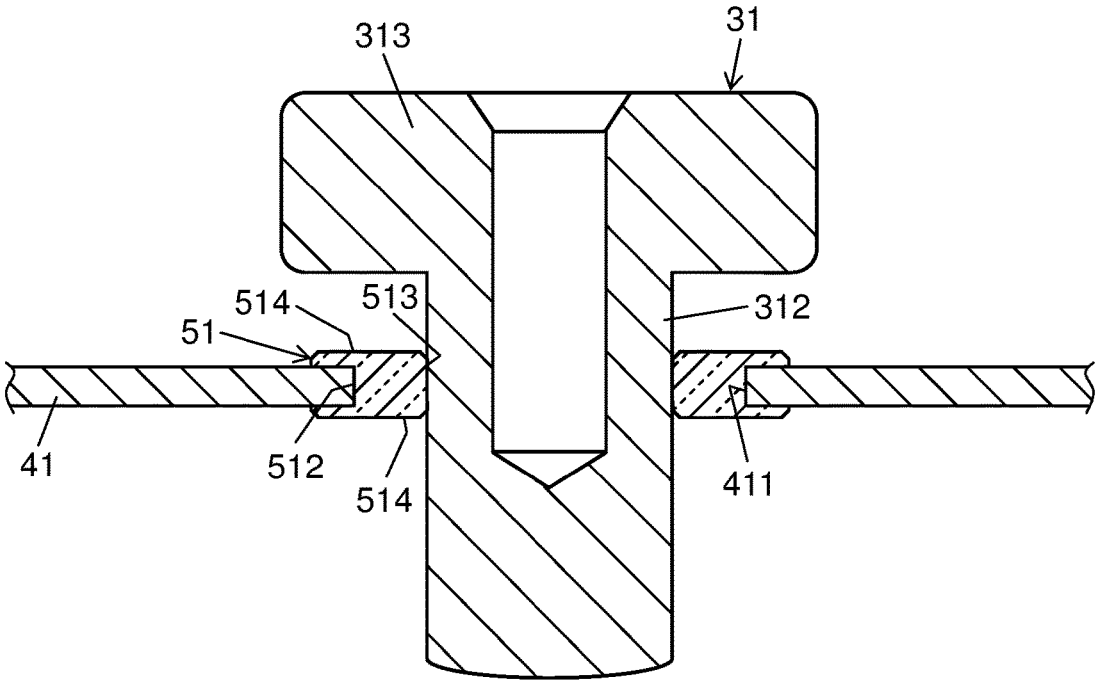
FIG. 12A is a cross-sectional view showing the main part of a contact device according to a second exemplary structure of the third exemplary embodiment.
Figure 12B:
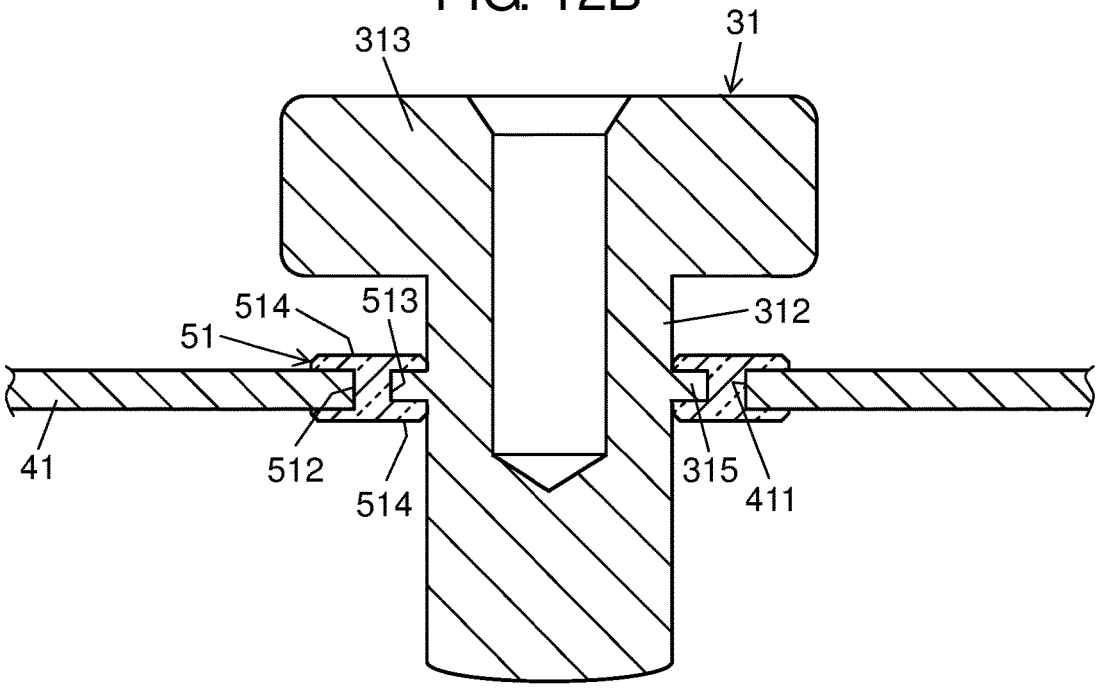
FIG. 12B is a cross-sectional view showing the main part of a contact device according to the second exemplary structure of the third exemplary embodiment.

As shown in FIGS. 12A and 12B, insulating member 51 according to a second exemplary structure is different from the first exemplary structure in that at least one of housing 4 and fixed terminal 31 digs into insulating member 51. In the following, the structure similar to that in the first exemplary structure is denoted by the identical reference character, and the description thereof is omitted as appropriate.

In the example shown in FIG. 12A, at housing-side joining portion 512 in the state where housing (bottom plate 41) 4 digs into insulating member 51, housing 4 is joined. In other words, at outer side surface 504 of insulating member 51, a groove is formed along the entire circumferential direction. Insulating member 51 and housing 4 are joined to each other so that the peripheral edge of opening hole 411 at bottom plate 41 fits into this groove. In this case, a portion of outer side surface 504 of insulating member 51 that is in contact with housing (bottom plate 41) 4, that is, the groove portion structures housing-side joining portion 512. With this structure, as compared to the first exemplary structure, the joining strength between insulating member 51 and housing 4, particularly the joining strength in the penetrating direction (top-bottom direction) increases. Further, since outer side surface 504 of insulating member 51 except for the groove portion structures insulation securing portions 514, as compared to the case where the entire outer side surface 504 of insulating member 51 is housing-side joining portion 512, the creepage distance between housing-side joining portion 512 and terminal-side joining portion 513 becomes greater. Accordingly, the insulating performance between housing 4 and fixed terminal 31 improves.

Further, in the example shown in FIG. 12B, in addition to the above-described structure (the structure shown in FIG. 12A), at terminal-side joining portion 513, fixed terminal 31 is joined in the state where fixed terminal 31 digs into insulating member 51. In other words, at inner side surface 503 of insulating member 51, a groove is formed along the entire circumferential direction. Insulating member 51 and fixed terminal 31 are joined to each other so that collar portion 315 provided at fixed terminal 31 fits into this groove. Collar portion 315 is formed to project from the outer circumferential surface of small-diameter portion 312 of fixed terminal 31, and is provided along the entire circumferential direction of small-diameter portion 312. In this case, a portion of inner side surface 503 of insulating member 51 that is in contact with fixed terminal 31, that is, the entire inner side surface 503 of insulating member 51 including groove portion structures terminal-side joining portion 513. With this structure, as compared to the first exemplary structure, the joining strength between insulating member 51 and fixed terminal 31, particularly the joining strength in the penetrating direction (the top-bottom direction) increases.

Note that, the structures shown in FIGS. 12A and 12B are merely examples. At least one of housing 4 and fixed terminal 31 digging into insulating member 51 will suffice. For example, just fixed terminal 31 may dig into insulating member 51. Further, in the case where terminal-side spacer 61 (see FIG. 1) or housing-side spacer 71 (see FIG. 1) is employed, at least one of terminal-side spacer 61 and housing-side spacer 71 may dig into insulating member 51.

(3) Third Exemplary Structure

Figure 13A:
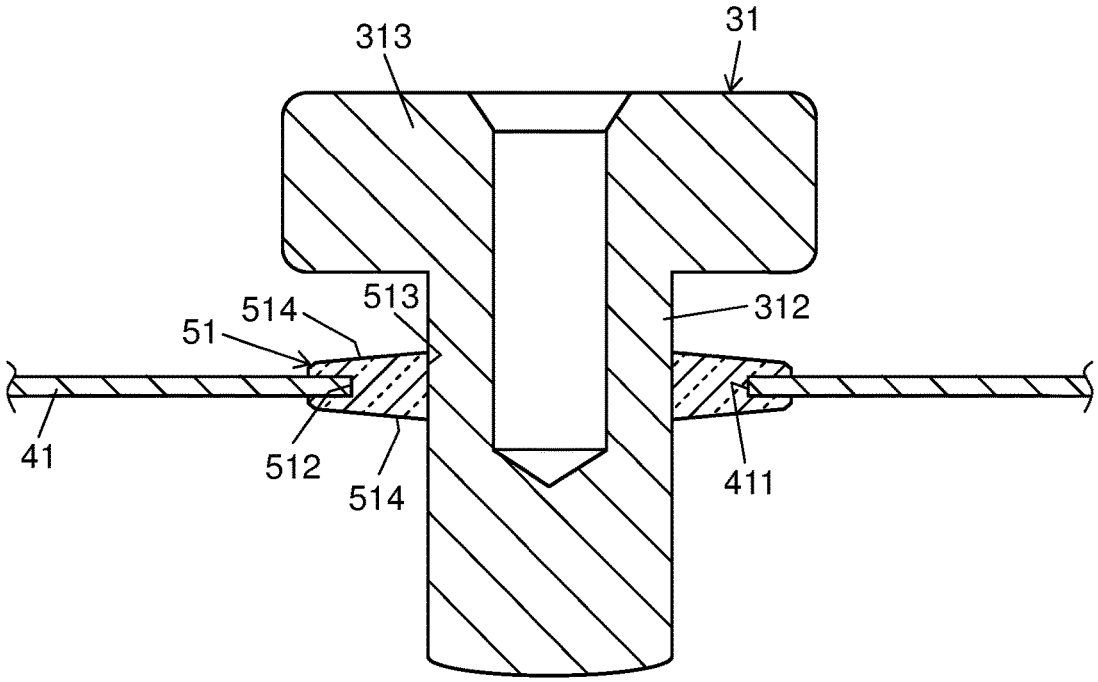
FIG. 13A is a cross-sectional view showing the main part of a contact device according to a third exemplary structure of the third exemplary embodiment.
Figure 13B:
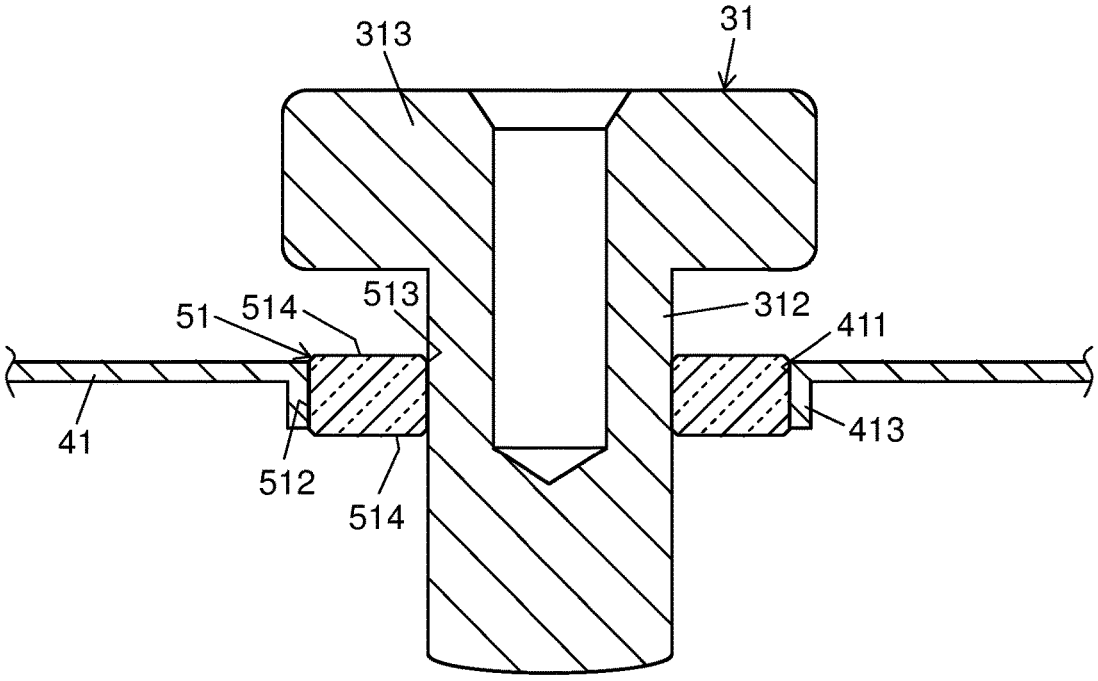
FIG. 13B is a cross-sectional view showing the main part of a contact device according to the third exemplary structure of the third exemplary embodiment.

As shown in FIGS. 13A and 13B, insulating member 51 according to a third exemplary structure is different from the second exemplary structure in that insulating member 51 is used for housing 4 including bottom plate 41 of a small (thin) thickness dimension. In the following, the structure similar to that in the second exemplary structure is denoted by the identical reference character, and the description thereof is omitted as appropriate.

In the example shown in FIG. 13A, insulating member 51 is structured to have a shape in which lower surface 501 and upper surface 502 are inclined so that the dimension (the thickness dimension) in the penetrating direction (the top-bottom direction) is smaller on outer side surface 504 side than on inner side surface 503 side. In the example shown in FIG. 13A, similarly to the example shown in FIG. 12A, at outer side surface 504 of insulating member 51, a groove is formed along the entire circumferential direction. Insulating member 51 and housing 4 are joined to each other so that the peripheral edge of opening hole 411 at bottom plate 41 fits into this groove. This structure allows use of housing 4 including bottom plate 41 of a small thickness dimension, which contributes toward reducing the size of contact device 1.

Further, in the example shown in FIG. 13B, circumferential wall 413 that projects downward from the peripheral edge of opening hole 411 at bottom plate 41 is formed, and housing 4 is joined to insulating member 51 at the inner side surface of circumferential wall 413. Circumferential wall 413 is formed by, for example, drawing. In this case, a portion of outer side surface 504 of insulating member 51 that is in contact with circumferential wall 413 structures housing-side joining portion 512. With this structure, since housing-side joining portion 512 is in surface contact with the inner side surface of circumferential wall 413, as compared to the above-described structure (the structure shown in FIG. 13A), the joining strength between insulating member 51 and housing 4 increases. Note that, housing 4 is not limited to have a structure in which circumferential wall 413 projects downward, and may have a structure in which circumferential wall 413 projects upward.

(4) Fourth Exemplary Structure

Figure 14:
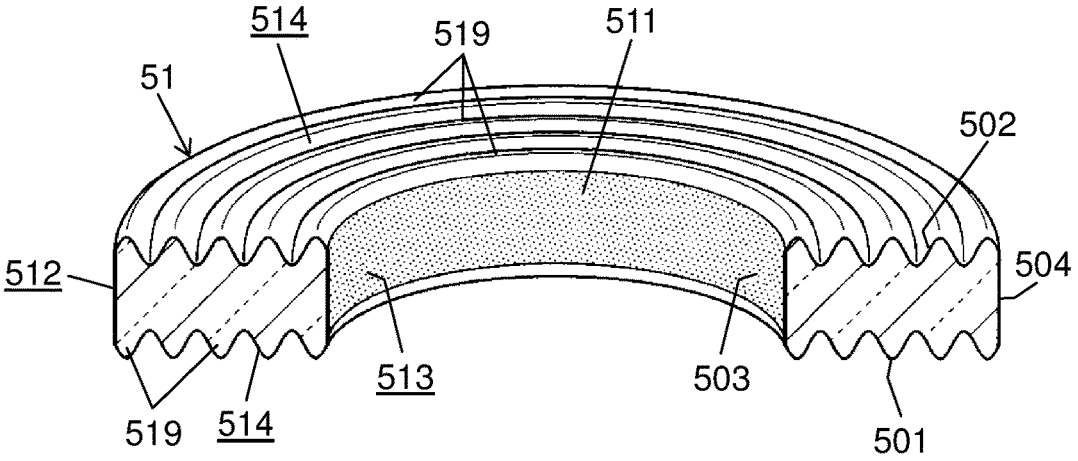
FIG. 14 is a perspective cross-sectional view of an insulating member according to a fourth exemplary structure of the third exemplary embodiment.

As shown in FIG. 14, in a fourth exemplary structure, insulation securing portion 514 includes ridge portions 519 formed so as to surround hollow portion 511, at least one of opposite end surfaces in the penetrating direction of insulating member 51, which one surface is provided with none of housing-side joining portion 512 and terminal-side joining portion 513. Ridge portions 519 project in the direction in which the dimension in the penetrating direction of insulating member 51 becomes greater, as compared to sites other than ridge portions 519, the sites being provided at a surface identical to ridge portions 519.

The shape of ridge portions 519 is similar to (first) protruding portions 517 described in "(2) Second Exemplary Structure" in the second exemplary embodiment. In the fourth exemplary structure, ridge portions 519 are provided at each of the opposite end surfaces (lower surface 501 and upper surface 502) in the penetrating direction of insulating member 51. Further, similarly to (first) protruding portions 517 described in "(3) Third Exemplary Structure" of the second exemplary embodiment, a plurality of (herein, five) ridge portions 519 are concentrically provided so as to surround hollow portion 511 at each of lower surface 501 and upper surface 502. Thus, lower surface 501 and upper surface 502 of insulating member 51 are formed to be corrugated with the plurality of ridge portions 519.

In the fourth exemplary structure described above, each insulation securing portion 514 includes ridge portions 519 formed at least one of the opposite end surfaces in the penetrating direction of insulating member 51. Accordingly, on the surface of insulating member 51, ridge portions 519 are interposed between housing-side joining portion 512 and terminal-side joining portion 513. Thus, as compared to the case where ridge portions 519 are not provided, the creepage distance between housing-side joining portion 512 and terminal-side joining portion 513 becomes greater by the amount of ridge portions 519, whereby the insulating performance between housing 4 and fixed terminal 31 improves.

(5) Variation

Insulating member 51 according to the present exemplary embodiment is not limited to the above-described structures, and can be modified as appropriate. For example, in the fourth exemplary structure, ridge portions 519 may be formed at just one of lower surface 501 and upper surface 502 of insulating member 51, or may be formed just one in number.

Other structure and function are similar to those of the first exemplary embodiment.

Fourth Exemplary Embodiment

Figure 15A:
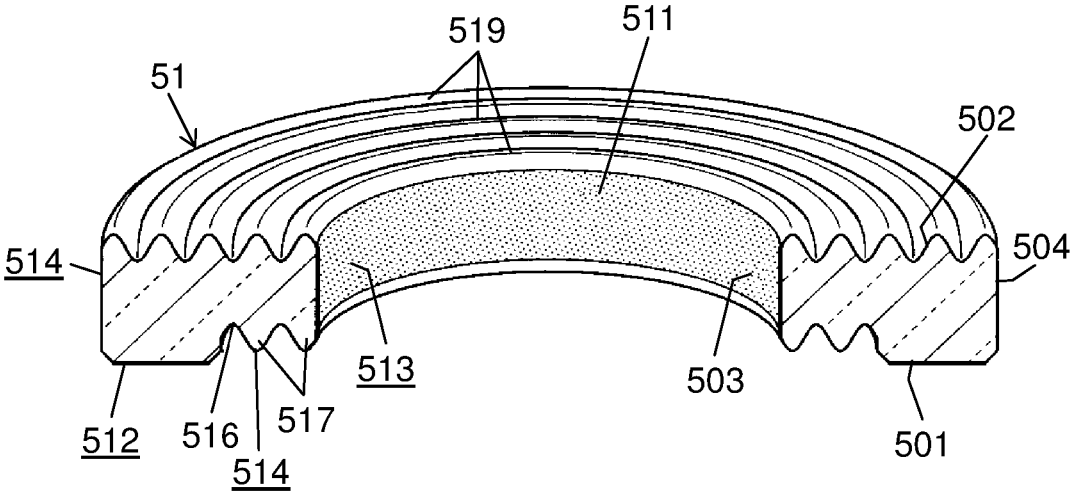
FIG. 15A is a cross-sectional perspective view showing an insulating member according to a fourth exemplary embodiment.
Figure 15B:
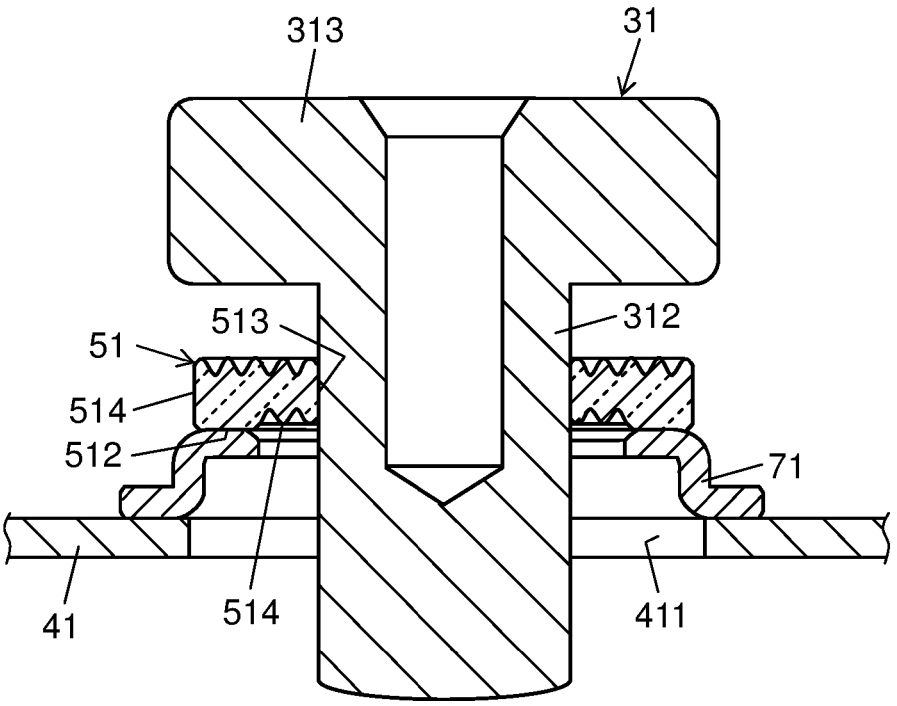
FIG. 15B is a cross-sectional view showing the main part of a contact device according to the fourth exemplary embodiment.

As shown in FIGS. 15A and 15B, contact device 1 according to the present exemplary embodiment is different from contact device 1 according to the third exemplary embodiment in that housing-side joining portion 512 is provided at one end surface (lower surface 501) in the penetrating direction of insulating member 51. Note that, in the present exemplary embodiment, a description will be given on the premise that, as to the structure other than insulating member 51, housing-side spacer 71 shown in FIG. 5 described as Variation of the first exemplary embodiment is employed. In the following, the structure similar to that in the third exemplary embodiment is denoted by the identical reference character, and the description thereof is omitted as appropriate.

In contact device 1 according to the present exemplary embodiment, terminal-side joining portion 513 is provided at inner side surface 503 of insulating member 51 similarly to the third exemplary embodiment. In the present exemplary embodiment, as shown in FIGS. 15A and 15B, upper surface 502 of insulating member 51, a portion of lower surface 501 of insulating member 51 except for housing-side joining portion 512, and outer side surface 504 of insulating member 51 structure insulation securing portion 514. Here, similarly to "(4) Fourth Exemplary Structure" of the third exemplary embodiment, a plurality of ridge portions 519 are formed at upper surface 502 of insulating member 51. Further, at insulation securing portion 514 at lower surface 501 of insulating member 51, similarly to "(3) Third Exemplary Structure" of the second exemplary embodiment, recessed portion 516 is formed, and a plurality of (herein, two) (first) protruding portions 517 are formed at the bottom surface of recessed portion 516.

In the structure of the present exemplary embodiment described above, since housing-side joining portion 512 is provided at lower surface 501 of insulating member 51 and terminal-side joining portion 513 is provided at inner side surface 503 of insulating member 51, insulating member 51 can support various combinations of housing 4 and fixed terminal 31.

Note that, while the present exemplary embodiment has shown the example in which housing-side joining portion 512 is provided at lower surface 501 of insulating member 51 and terminal-side joining portion 513 is provided at inner side surface 503 of insulating member 51, the present invention is not limited to this structure. The structures of the first and second exemplary embodiments and the structure of the third exemplary embodiment can be combined as appropriate. That is, housing-side joining portion 512 may be provided at outer side surface 504 of insulating member 51, and terminal-side joining portion 513 may be provided at one end surface (upper surface 502) in the penetrating direction of insulating member 51. Thus, insulating member 51 can support further various combinations of housing 4 and fixed terminal 31.

Further, the structure of the present exemplary embodiment can be combined as appropriate with the structure described in the second exemplary embodiment and the structure described in the third exemplary embodiment.

Other structure and function are similar to those of the third exemplary embodiment.

Fifth Exemplary Embodiment

Figure 16:
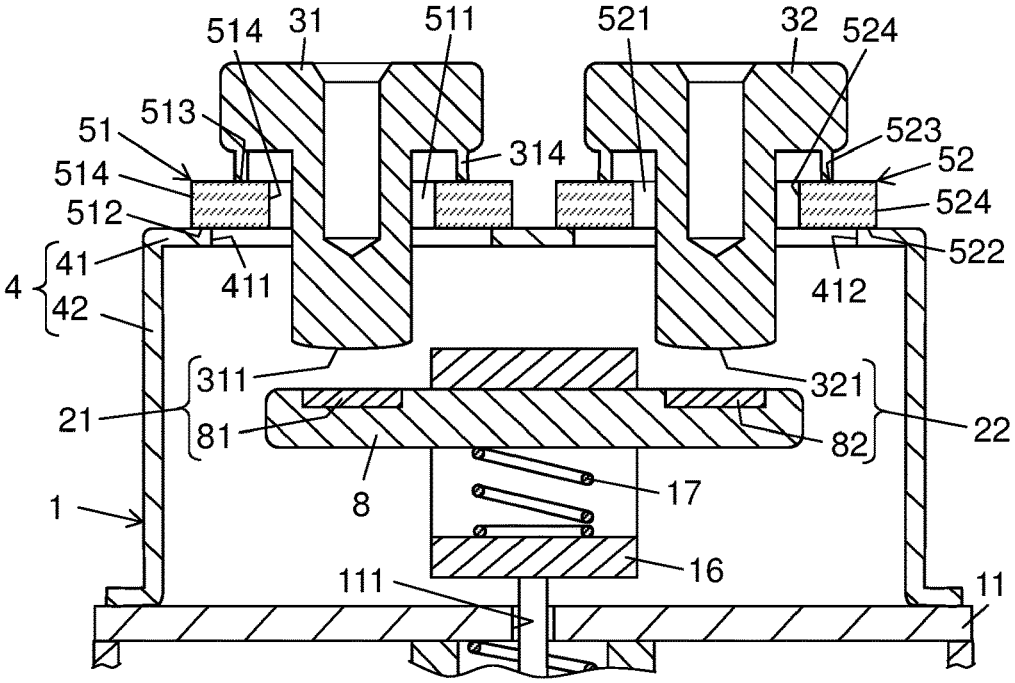
FIG. 16 is a cross-sectional view showing a contact device according to a fifth exemplary embodiment.

As shown in FIG. 16, contact device 1 according to the present exemplary embodiment is different from contact device 1 according to the first exemplary embodiment in that bottom plate 41 and a site other than bottom plate 41 in housing 4 (tubular portion 42) are formed by a single member. In the following, the structure similar to that in the first exemplary embodiment is denoted by the identical reference character, and the description thereof is omitted as appropriate.

In the present exemplary embodiment, bottom plate 41 is seamlessly formed to be continuous to tubular portion 42. Here, as an example, housing 4 made of Alloy 42 (Fe-42Ni) is employed. However, it is not intended to limit housing 4 to be made of Alloy 42, and housing 4 may be made of Kovar or the like, for example.

Figure 17:
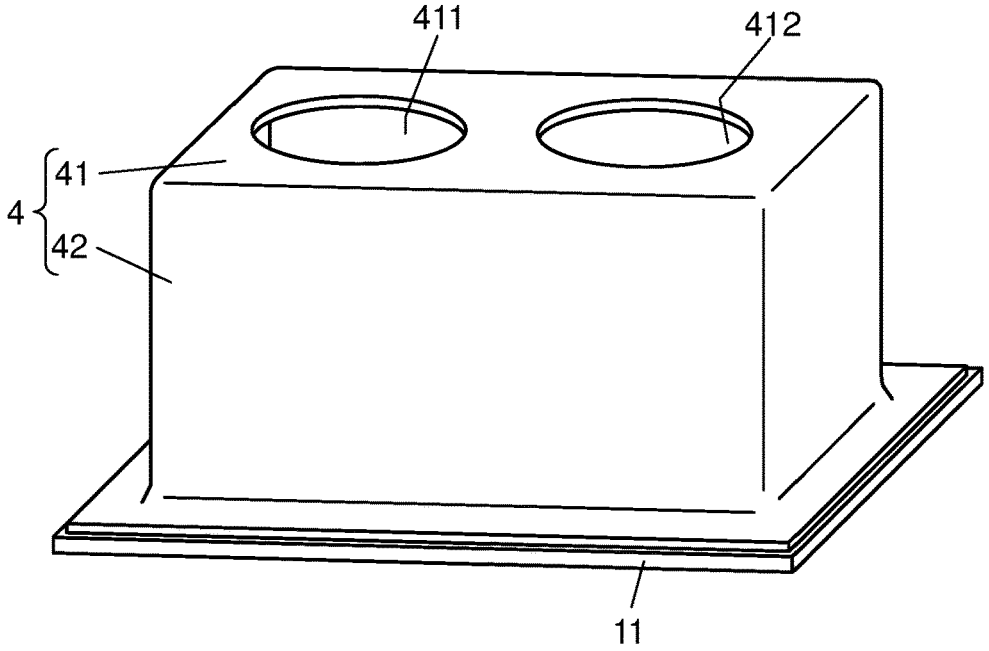
FIG. 17 is a perspective view showing a housing of the contact device according to the fifth exemplary embodiment.

As shown in FIG. 17, housing 4 is formed by drawing from a single metal plate, to be hollow rectangular parallelepiped-like elongated in the right-left direction whose lower side is opened. The lower side of housing 4 is closed by yoke upper plate 11. A pair of opening holes 411, 412 is formed at sites serving as bottom plate 41 in housing 4. Note that, in the present exemplary embodiment also, similarly to the first exemplary embodiment, housing 4 is just required to be formed to be box-like surrounding contact portions 21, 22, and is not limited to be hollow rectangular parallelepiped-like. For example, housing 4 may be bottomed elliptical tubular or hollow polygonal prism-like. For example, when housing 4 is bottomed elliptical tubular, the site in housing 4 serving as bottom plate 41 is elliptical.

Further, in the example shown in FIG. 16, contact device 1 does not include terminal-side spacers 61, 62 (see FIG. 1) and housing-side spacers 71, 72 (see FIG. 1). Note that, in the following, fixed terminal 31, opening hole 411, small-diameter portion 312, increased-diameter portion 313, (first) leg portion 314, and insulating member 51 can be read as fixed terminal 32, opening hole 412, small-diameter portion 322, increased-diameter portion 323, (second) leg portion 324, and insulating member 52, respectively.

Figure 18:
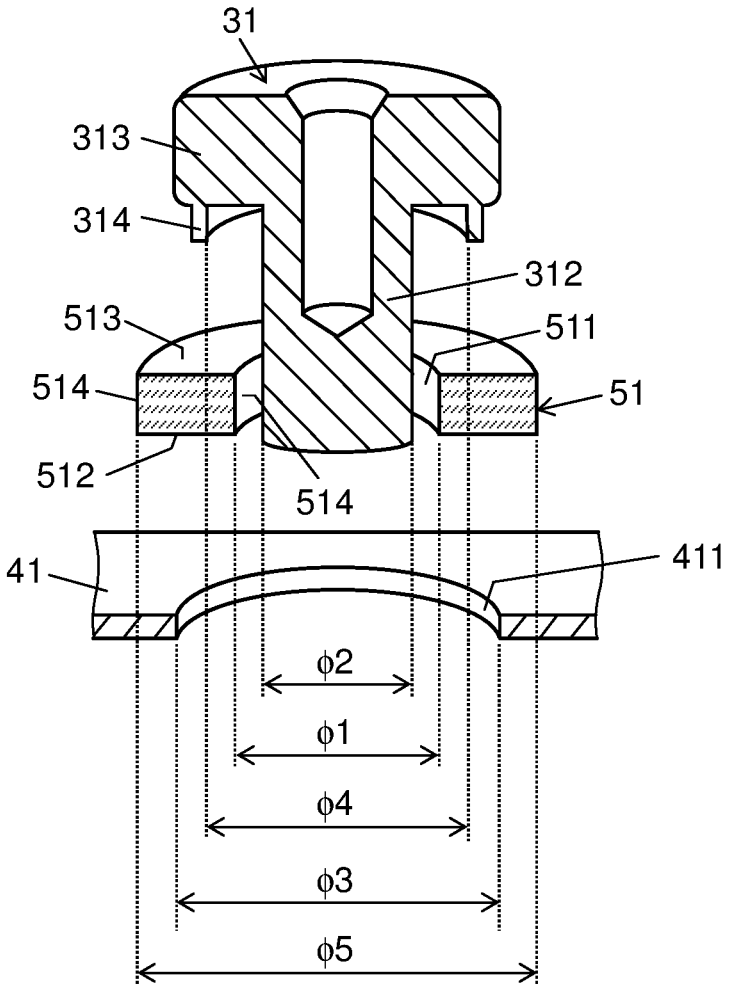
FIG. 18 is a perspective cross-sectional view showing the main part of the contact device according to the fifth exemplary embodiment.

Specifically, similarly to the second exemplary embodiment, contact device 1 shown in FIG. 16 has, as shown in FIG. 18, annular leg portion 314 that projects downward from the lower surface of increased-diameter portion 313 along the outer circumferential surface of small-diameter portion 312, at fixed terminal 31. Here, inner diameter $\varphi 4$ of leg portion 314 is set to be greater than inner diameter $\varphi 1$ of insulating member 51, and to be smaller than outer diameter $\varphi 5$ of insulating member 51 ($\varphi 1<\varphi 4<\varphi 5$). Note that, outer diameter $\varphi 5$ of insulating member 51 is set to be greater than inner diameter $\varphi 3$ of opening hole 411 ($\varphi 5>\varphi 3$).

Fixed terminal 31 has the tip (lower end) of leg portion 314 directly joined to insulating member 51 in the state where the tip surface (lower end surface) of leg portion 314 is in contact with the upper surface of insulating member 51. Thus, fixed terminal 31 is directly fixed to insulating member 51. Fixed terminal 31 and insulating member 51 are joined to each other by brazing.

Insulating member 51 has its lower surface directly joined to bottom plate 41 in the state where its lower surface is in contact with bottom plate 41 around opening hole 411 at the upper surface of bottom plate 41. Thus, insulating member 51 is directly fixed to housing 4 (bottom plate 41). Insulating member 51 and bottom plate 41 are joined to each other by brazing. In the process of brazing, insulating member 51 and bottom plate 41 are placed in a high temperature environment. Accordingly, bottom plate 41 is made of a metal material (Alloy 42 or Kovar) whose thermal coefficient of expansion is closer to that of insulating member (ceramic) 51.

In the structure described above, since bottom plate 41 and the site other than bottom plate 41 in housing 4 are formed by a single member, as compared to the case where these are separate members, the number of components of housing 4 can be reduced. Further, by virtue of the above-described contact device 1 not including a terminal-side spacer and a housing-side spacer, a further reduction in the number of components can be achieved. Note that, in the case where a terminal-side spacer is not included, preferably fixed terminal 31 has leg portion 314 and the tip of leg portion 314 is joined to insulating member 51 as described above.

Meanwhile, the absence of a terminal-side spacer and a housing-side spacer is not essential for contact device 1 according to the present exemplary embodiment, and a terminal-side spacer or a housing-side spacer may be employed as necessary. In the following, fixed terminal 31, insulating member 51, terminal-side spacer 61, and housing-side spacer 71 can be read as fixed terminal 32, insulating member 52, terminal-side spacer 62, and housing-side spacer 72, respectively.

Figure 19:
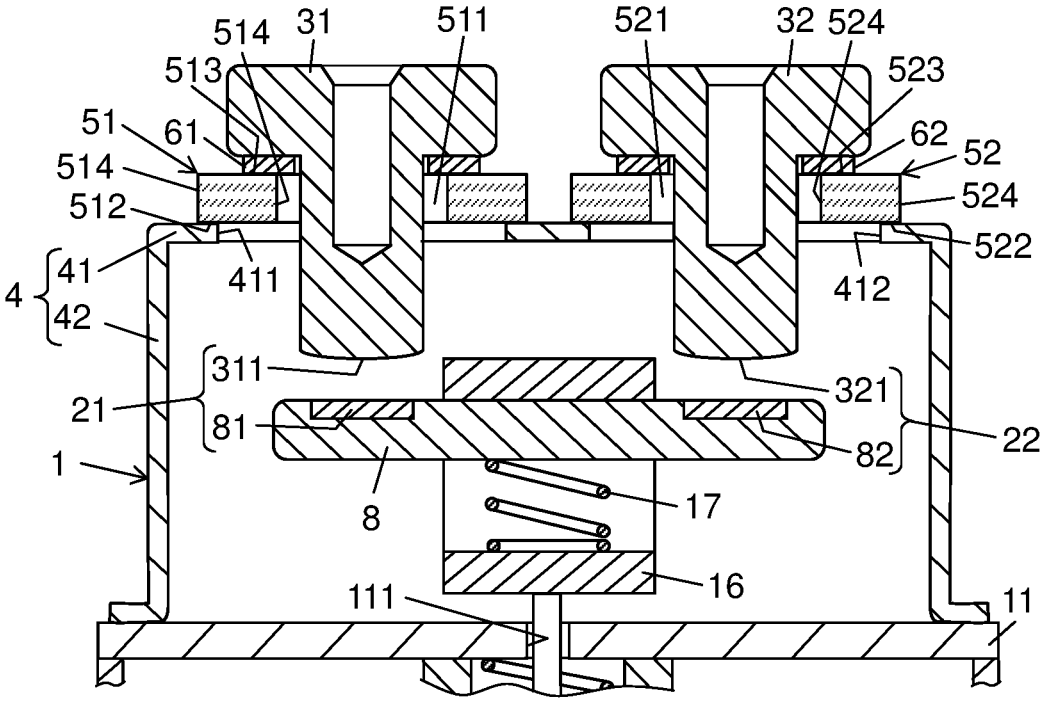
FIG. 19 is a cross-sectional view showing other example of the contact device according to the fifth exemplary embodiment.

FIG. 19 shows contact device 1 in which terminal-side spacer 61 is added to the structure shown in FIG. 16. In the example shown in FIG. 19, similarly to the first exemplary embodiment, leg portion 314 of fixed terminal 31 is eliminated. Metal-made terminal-side spacer 61 is provided between fixed terminal 31 and insulating member 51, and fixed terminal 31 is joined to insulating member 51 via terminal-side spacer 61.

Figure 20:
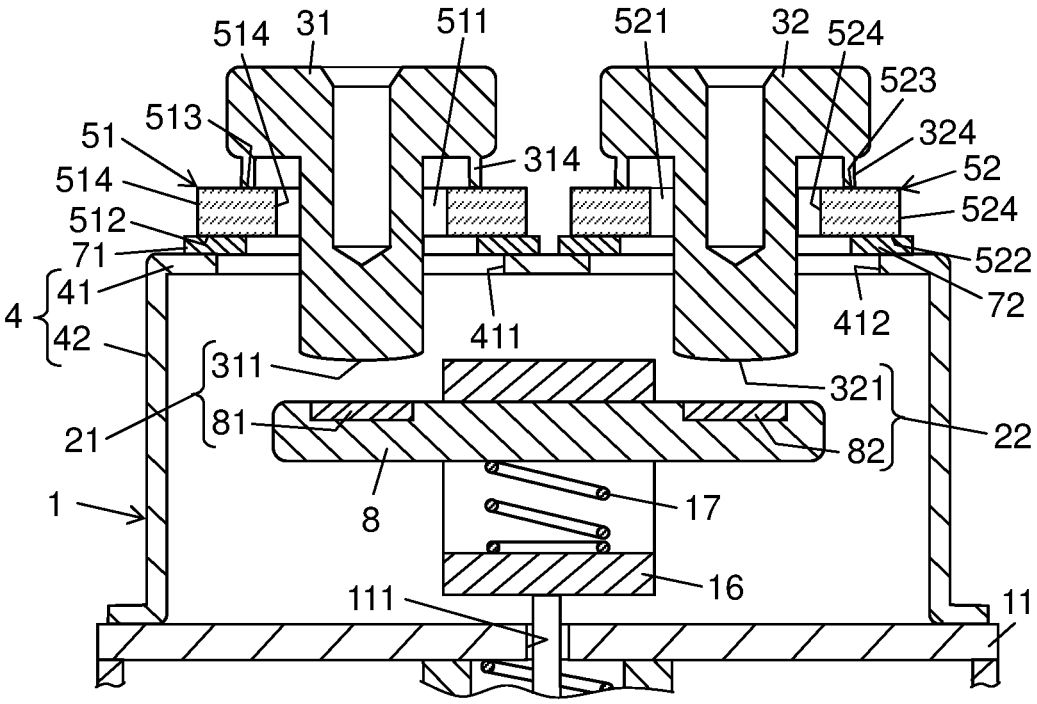
FIG. 20 is a cross-sectional view showing another example of the contact device according to the fifth exemplary embodiment.

FIG. 20 shows contact device 1 in which housing-side spacer 71 is added to the structure shown in FIG. 16. In the example shown in FIG. 20, similarly to the first exemplary embodiment, metal-made housing-side spacer 71 is provided between insulating member 51 and bottom plate 41, and insulating member 51 is joined to bottom plate 41 via housing-side spacer 71.

Further, combining the structure shown in FIG. 19 and that shown in FIG. 20, contact device 1 may include both terminal-side spacer 61 and housing-side spacer 71 similarly to the first exemplary embodiment.

Still further, the structure according to the present exemplary embodiment can be employed in combination with the structure described in the second exemplary embodiment, the structure described in the third exemplary embodiment, and the structure described in the fourth exemplary embodiment as appropriate.

Other structure and function are similar to those of the first exemplary embodiment.

Note that, in the present exemplary embodiment, (first) fixed terminal 31 and (second) fixed terminal 32 are not necessarily structured to be identical to each other, and they may have different structures. For example, (first) fixed terminal 31 may have the structure shown in FIG. 1 while (second) fixed terminal 32 may have the structure shown in FIG. 18. In this manner, any combination of the above-described structures can be contemplated as to (first) fixed terminal 31 and (second) fixed terminal 32.

REFERENCE MARKS IN THE DRAWINGS

1: contact device
10: electromagnet device
100: electromagnetic relay
21, 22: contact portion
31, 32: fixed terminal
4: housing
41: bottom plate
411, 412: opening hole
51, 52: insulating member
511, 521: hollow portion
512, 522: housing-side joining portion
513, 523: terminal-side joining portion
514, 524: insulation securing portion
515: metal layer
516: recessed portion
517: (first) protruding portion
518: (second) protruding portion
519: ridge portion
61, 62: terminal-side spacer
71, 72: housing-side spacer

The invention claimed is:

1. A contact device comprising:
a first contact portion;
a first fixed terminal that is electrically connected to the first contact portion;
a second contact portion;
a second fixed terminal that is electrically connected to the second contact portion;
a housing that is box-like in shape and disposed so as to surround the first contact portion and the second contact portion, the housing including a bottom plate having a first opening hole through which the first fixed terminal passes and a second opening hole through which the second fixed terminal passes;
a first insulating member that is electrically insulating, and directly or indirectly joined to the bottom plate around the first opening hole; and
a second insulating member that is electrically insulating, and directly or indirectly joined to the bottom plate around the second opening hole, wherein:
the first fixed terminal penetrates through a first region surrounded by the first insulating member,
the second fixed terminal penetrates through a second region surrounded by the second insulating member,
a first housing-side joining portion to which the housing is directly or indirectly joined is provided,
a second housing-side joining portion to which the housing is directly or indirectly joined is provided,
a first terminal-side joining portion to which the first fixed terminal is directly or indirectly joined is provided,
a second terminal-side joining portion to which the second fixed terminal is directly or indirectly joined is provided,
the first housing-side joining portion is provided at a lower surface of the first insulating member, and an outer circumference of the lower surface of the first insulating member is in contact with the first housing-side joining portion,
the second housing-side joining portion is provided at a lower surface of the second insulating member, an outer circumference of the lower surface of the second insulating member is in contact with the second housing-side joining portion, and
the bottom plate of the housing is made of metal.

2. The contact device according to claim 1, wherein the housing includes the bottom plate and a site other than the bottom plate as separate members.

3. The contact device according to claim 1, wherein:
a first housing-side spacer made of metal is provided between the first insulating member and the bottom plate,
a second housing-side spacer made of metal is provided between the second insulating member and the bottom plate,
the first housing-side joining portion is joined to the bottom plate via the first housing-side spacer, and
the second housing-side joining portion is joined to the bottom plate via the second housing-side spacer.

4. The contact device according to claim 1, wherein
a first terminal-side spacer made of metal is provided between the first fixed terminal and the first insulating member, and
the first fixed terminal is joined to the first terminal-side joining portion via the first terminal-side spacer.

5. The contact device according to claim 1, wherein the housing is made of metal, a first housing-side spacer made of metal is provided between the first insulating member and the bottom plate, the first housing-side joining portion is joined to the bottom plate via the first housing-side spacer, a first terminal-side spacer made of metal is provided between the first fixed terminal and the first insulating member, and the first fixed terminal is joined to the first terminal-side joining portion via the first terminal-side spacer.

6. The contact device according to claim 1, wherein:

the first terminal-side joining portion is provided at the upper surface of the first insulating member, and the second terminal-side joining portion is provided at the upper surface of the second insulating member.

7. The contact device according to claim 1, wherein a direction in which the first fixed terminal penetrates through the first region is a penetrating direction, in a surface of the first insulating member, a first insulation securing portion being electrically insulating is provided at a position where the first housing-side joining portion and the first terminal-side joining portion are spaced apart from each other, the first insulation securing portion includes a recessed portion formed so as to surround the first region at one of the upper surface and the lower surface of the first insulating member, the one surface being provided with at least one of the first housing-side joining portion and the first terminal-side joining portion, and the recessed portion is recessed in a direction in which a dimension in the penetrating direction of the first insulating member becomes smaller as compared to one of the first housing-side joining portion and the first terminal-side joining portion, the one joining portion being provided at a surface identical to the recessed portion.

8. The contact device according to claim 7, wherein a protruding portion formed so as to surround the first region is provided at a bottom surface of the recessed portion, and the protruding portion projects in a direction in which a dimension in the penetrating direction of the first insulating member becomes greater as compared to a site other than the protruding portion in the bottom surface of the recessed portion.

9. The contact device according to claim 8, wherein, in the penetrating direction, a dimension from the bottom surface of the recessed portion to a tip of the protruding portion is smaller than a dimension from the bottom surface of the recessed portion to one of the upper surface and the lower surface of the first insulating member, the one surface being provided with the recessed portion.

10. The contact device according to claim 1, wherein a direction in which the first fixed terminal penetrates through the first region is a penetrating direction, in a surface of the first insulating member, a first insulation securing portion being electrically insulating is provided at a position where the first housing-side joining portion and the first terminal-side joining portion are spaced apart from each other, the first insulation securing portion includes a protruding portion formed so as to surround the first region at one of opposite end surfaces in the penetrating direction of the first insulating member, the one surface being provided with at least one of the first housing-side joining portion and the first terminal-side joining portion, and the protruding portion projects in a direction in which a dimension in the penetrating direction of the insulating member becomes greater as compared to one of the first housing-side joining portion and the first terminal-side joining portion, the one joining portion being provided at a surface identical to the protruding portion.

11. The contact device according to claim 1, wherein a protruding portion formed so as to surround the first region is provided at one of the upper surface and the lower surface of the first insulating member, the one surface being provided with at least one of the first housing-side joining portion and the first terminal-side joining portion, and the protruding portion is provided to be annular so as to surround the first region.

12. The contact device according to claim 1, wherein a metal layer is provided at a surface of at least one of the first housing-side joining portion and the first terminal-side joining portion.

13. An electromagnetic relay comprising:

the contact device according to claim 1, and an electromagnet device that drives to open and close the first contact portion and the second contact portion.

14. A method for manufacturing a contact device including: a first contact portion; a first fixed terminal that is electrically connected to the first contact portion; a second contact portion; a second fixed terminal that is electrically connected to the second contact portion; a housing that is box-like in shape and disposed so as to surround the first contact portion and the second contact portion, the housing including a bottom plate made of metal having a first opening hole through which the first fixed terminal passes and a second opening hole through which the second fixed terminal passes; a first insulating member that is electrically insulating, and directly or indirectly joined to the bottom plate made of metal around the first opening hole; and a second insulating member that is electrically insulating, and directly or indirectly joined to the bottom plate made of metal around the second opening hole, the method comprising:

a fixing step of causing the first fixed terminal to penetrate through a first region surrounded by the first insulating member and causing the second fixed terminal to penetrate through a second region surrounded by the second insulating member; and a joining step of joining the first insulating member to the bottom plate made of metal around the first opening hole and joining the second insulating member to the bottom plate made of metal around the second opening hole while adjusting relative positions of the first and second fixed terminals relative to the housing, so that the first fixed terminal is held to the housing via the first insulating member and the second fixed terminal is held to the housing via the second insulating member, wherein:

a first housing-side joining portion, to which the housing is directly or indirectly joined, is provided at a lower surface of the first insulating member, and an outer circumference of the lower surface of the first insulating member is in contact with the first housing-side joining portion, and a second housing-side joining portion, to which the housing is directly or indirectly joined, is provided at a lower surface of the second insulating member, an outer circumference of the lower surface of the second insulating member is in contact with the second housing-side joining portion.

15. The contact device according to claim 1, wherein:

the first insulating member has a ring shape having an inner radius, an outer radius and a thickness in a direction that the first fixed terminal pass through the first insulating member, and a maximum of the thickness is smaller than a difference between the outer radius and the inner radius, and the second insulating member has a ring shape having an inner radius, an outer radius and a thickness in a direction that the second fixed terminal pass through the second insulating member, and a maximum of the thickness is smaller than a difference between the outer radius and the inner radius.

16. The contact device according to claim 3, wherein:

the first housing-side spacer is made of a first metal plate having a pair of opposed main surfaces, one of the main surfaces of the first metal plate is joined to the lower surface of the first insulating member, and the second housing-side spacer is made of a second metal plate having a pair of opposed main surfaces, one of the main surfaces of the second metal plate is joined to the lower surface of the second insulating member.

17. The contact device according to claim 1, wherein:

an entirety of the first insulating member is disposed outside the housing, and an entirety of the second insulating member is disposed outside the housing.

18. The contact device according to claim 3, wherein:

an entirety of the first insulating member is disposed outside the housing, and an entirety of the second insulating member is disposed outside the housing.

19. The contact device according to claim 3, wherein the bottom plate of the housing is made of metal.

* * * * *